US007975754B2

(12) United States Patent
Otsuka et al.

(10) Patent No.: US 7,975,754 B2
(45) Date of Patent: Jul. 12, 2011

(54) THIN CAST STEEL STRIP WITH REDUCED MICROCRACKING

(75) Inventors: Hiroyuki Otsuka, Yokohama (JP); Koshiro Yamane, Yokohama (JP); Satoshi Terasaki, Okegawa (JP); Mark Schlichting, Crawfordsville, IN (US); Rama Ballav Mahapatra, Brighton-Le-Sands (AU); David J. Sosinsky, Carmel, IN (US)

(73) Assignee: Nucor Corporation, Charlotte, NC (US)

( * ) Notice: Subject to any disclaimer, the term of this patent is extended or adjusted under 35 U.S.C. 154(b) by 679 days.

(21) Appl. No.: 11/837,851

(22) Filed: Aug. 13, 2007

(65) Prior Publication Data

US 2009/0047536 A1 Feb. 19, 2009

(51) Int. Cl.
*B22D 11/06* (2006.01)

(52) U.S. Cl. ..... 164/480; 164/428

(58) Field of Classification Search ..... 164/480, 164/428; 148/320

See application file for complete search history.

(56) References Cited

U.S. PATENT DOCUMENTS

| | | | |
|---|---|---|---|
| 5,063,990 | A | 11/1991 | Follstaedt et al. |
| 5,297,614 | A | 3/1994 | Bessho et al. |
| 5,390,726 | A | 2/1995 | Fukuda et al. |
| 5,807,444 | A | 9/1998 | Paradis et al. |
| 5,901,777 | A | 5/1999 | Matsumura et al. |
| 5,934,359 | A | 8/1999 | Strezov |
| 6,059,014 | A | 5/2000 | Strezov |
| 6,386,271 | B1 | 5/2002 | Kawamoto et al. |
| 6,491,089 | B1 | 12/2002 | Poirier et al. |
| 6,588,494 | B1 | 7/2003 | Mazurier et al. |
| 6,622,779 | B1 | 9/2003 | Mazurier |
| 6,679,313 | B2 | 1/2004 | Poirier et al. |
| 6,739,383 | B1 | 5/2004 | Marchionni et al. |
| 7,117,925 | B2 | 10/2006 | Strezov et al. |
| 7,156,151 | B2 | 1/2007 | Mahapatra et al. |
| 7,296,614 | B2 | 11/2007 | Schlichting et al. |
| 2005/0082031 | A1 | 4/2005 | Mahapatra et al. |
| 2006/0191612 | A1 | 8/2006 | Yoshida et al. |
| 2007/0144632 | A1 | 6/2007 | Toyoda et al. |
| 2007/0175608 | A1 | 8/2007 | Mahapatra et al. |

FOREIGN PATENT DOCUMENTS

| | | |
|---|---|---|
| JP | 03-248750 | 11/1991 |
| JP | 03-294419 | 12/1991 |
| JP | 04-045223 | 2/1992 |
| JP | 07-314097 | 12/1995 |
| JP | 08-192250 | 7/1996 |

(Continued)

OTHER PUBLICATIONS

PCT/AU2008/001164 Further Written Opinion.

(Continued)

*Primary Examiner* — Kevin P Kerns

(74) *Attorney, Agent, or Firm* — Arland T. Stein; Hahn Loeser & Parke LLP

(57) ABSTRACT

A thin cast steel strip and method of making thereof with improved resistance to microcracking, where the steel strip is produced by continuous casting and contains a carbon content between about 0.010% and about 0.065% by weight, less than 5.0% by weight chromium, at least 70 ppm of total oxygen and between 20 and 70 ppm of free oxygen, and manganese to sulfur ratio greater than about 250. The carbon content in the cast strip may be below about 0.035%, less than 0.005% by weight titanium, and the average manganese to silicon ratio in the strip produced may be greater than 3.5. The carbon content may be less than 0.035%, the casting speed less than 76.68 meters per minute, and the tundish temperature of the molten metal is maintained below 1612° C. (2933.7° F.).

24 Claims, 25 Drawing Sheets

FOREIGN PATENT DOCUMENTS

| | | | |
|---|---|---|---|
| NZ | 270147 | | 12/1994 |
| WO | 02/028569 | | 4/2002 |
| WO | 03/024644 | A1 | 3/2003 |

OTHER PUBLICATIONS

PCT/AU2008/001164 International Search Report.
PCT/AU2008/001164 Written Opinion.
AU2008900484 Search Report.

Mean microcrack rate by 2 values of Mn/Sulfur Ratio

Mean microcrack rate by 2 values of Mn/Si Ratio

Mean microcrack rate by 2 values of Mn/Si Ratio

Mean microcrack rate by 2 values of Carbon

Mean microcrack rate by 2 values of Carbon

Mean microcrack rate by 2 values of Nitrogen

Mean microcrack rate by 2 values of Nitrogen

Mean microcrack rate by 2 values of Cast Speed

Mean microcrack rate by 2 values of Cast Speed

Mean microcrack rate by 2 values of Tundish Temperature

Mean microcrack rate by 2 values of Tundish Temperature

Mean microcrack rate by 5 values of Cast Speed

Mean microcrack rate by 5 values of Cast Speed

Crack Evaluation

Date:
Sequence # / Heat # - Coil #: 3415-3, 195408-03
Inspector: mc

Bottom Side

| DS | BA | BB | BC | BD | BE | BF | BG | OS |
|---|---|---|---|---|---|---|---|---|
| | | | | clean | | | | |

Comments: 4% Elong

Top Side

| DS | TA | TB | TC | TD | TE | TF | TG | OS |
|---|---|---|---|---|---|---|---|---|
| | | | | clean | | | | |

Comments: 4% Elong

Fig. 25

THIN CAST STEEL STRIP WITH REDUCED MICROCRACKING

BACKGROUND AND SUMMARY OF THE INVENTION

This invention relates generally to steelmaking, and particularly carbon steels formed by continuous casting of thin strip.

Thin steel strip may be formed by continuous casting in a twin roll caster. In twin roll casting, molten metal is introduced between a pair of counter-rotated laterally positioned casting rolls, which are cooled, so that metal shells solidify on the moving roll surfaces and are brought together at the nip between the rolls to produce a solidified strip product delivered downwardly from the nip. The term "nip" is used herein to refer to the general region at which the rolls are closest together. The molten metal may be poured from a ladle into a smaller vessel from which it flows through a metal delivery nozzle located above the nip to form a casting pool of molten metal supported on the casting surfaces of the rolls and extending along the length of the nip. This casting pool is usually confined between side plates or dams held in sliding engagement with end surfaces of the rolls so as to dam the two ends of the casting pool against outflow.

When casting thin strip with a twin roll caster, the molten metal in the casting pool will generally be at a temperature of the order of 1500° C., and usually 1600° C. and above. A high heat flux and extensive nucleation on initial solidification of the metal shells on the casting surfaces is needed to form the steel strip. U.S. Pat. No. 5,720,336 describes how the heat flux on initial solidification can be increased by adjusting the steel melt chemistry such that a substantial portion of the metal oxides formed are liquid at the initial solidification temperature. As disclosed in U.S. Pat. Nos. 5,934,359 and 6,059,014 and International Application AU 99/00641, nucleation of the steel on initial solidification can be influenced by the texture of the casting surface. In particular, International Application AU 99/00641 discloses that a random texture of peaks and troughs in the casting surfaces can enhance initial solidification by providing substantial nucleation sites distributed over the casting surfaces.

Attention has been given in the past to the steel chemistry of the melt, particularly in the ladle metallurgy furnace before the casting of the thin strip. In the past, in U.S. Pat. No. 7,048,033 attention has been given to controlling the oxide inclusions and the oxygen levels in the steel metal and their impact on the quality of the steel strip produced. In U.S. Pat. No. 7,156,151, hydrogen levels and nitrogen levels have been regulated in the molten metal to enhance the casting and quality of the steel strip. In U.S. Pat. No. 6,547,849, a method is disclosed of providing silicon/manganese killed molten steel having a sulfur content of less than 0.02% by weight for casting. Finally, in U.S. patent application Ser. No. 11/622,754, filed Jan. 12, 2007, and published as U.S. 2007/0175608 on Aug. 2, 2007, now abandoned, a thin cast strip with reduced microcracks and method of making the same is disclosed by controlling the sulfur content of the cast strip to between about 0.003% and about 0.008% by weight, along with the carbon content to between about 0.010% and about 0.065% by weight.

In these prior disclosures, the teachings are generally to have low sulfur levels, such as less than 0.025 or 0.02%. See, e.g., International Application AU 99/00641 and U.S. Pat. No. 6,547,849. There is no suggestion of purposely providing very low levels of sulfur to reduce or eliminate microcracking, or for any other purpose, except for U.S. application Ser. No. 11/622,754, filed Jan. 12, 2007, now abandoned. There has been no suggestion to our knowledge of controlling the ratios of manganese/sulfur or manganese/silicon for any reason in the casting of thin strip, or any other steelmaking.

Generally, sulfur has been an undesirable impurity in steelmaking, including in continuous casting of thin strip. Steelmakers generally go to great lengths and expense to minimize sulfur content in making steel. Sulfur is primarily present as sulfide inclusions, such as MnS inclusions. Sulfide inclusions may provide sites for voids and/or surface cracking. Sulfur may also decrease ductility and notch impact toughness of the cast steel, especially in the transverse direction. Further, sulfur creates red shortness, or brittleness in red hot steel. Sulfur also reduces weldability. Sulfur is generally removed from molten steel by a desulphurization process. Steel for continuous casting may be subjected to a deoxidation and then desulphurization in the ladle metallurgy, prior to casting. One such method involves stirring the molten steel by injecting inert gases, such as argon or nitrogen, while the molten metal is in contact with slag having a high calcium content. See U.S. Pat. No. 6,547,849.

On the other hand, thin cast strip formed by twin roll casting has been known to have a tendency to form microcracks in the strip surface. One cause has been the formation of an oxide layer on the surface of the casting rolls that acts as a thermal barrier causing irregular solidification of the cast strip and formation of microcracks in the strip surface.

We have found that microcracking is related to the steel chemistry and certain process parameters. That the "strength" of newly formed shells can be made resistant and reduce the formation of microcracks in the cast strip surface. We have also observed that sulfur is a surface active element in liquid steel. From these observations, we have found that microcracking in the cast strip of low carbon steel can be controlled by regulating the ratio of sulfur to manganese in the molten metal, oxygen and free-oxygen and also to a lesser degree the ratio of manganese to silicon in the molten metal.

The present disclosure describes a thin cast steel strip produced by continuous casting by steps comprising:

a. assembling a pair of internally cooled casting rolls having a nip therebetween and with confining closures adjacent the ends of the nip;
b. introducing molten low carbon steel having a carbon content of between about 0.010% and about 0.065% by weight, less than 5.0% by weight chromium, at least 70 ppm of total oxygen and between 20 and 70 ppm of free oxygen, and an average manganese to sulfur ratio at least 250 between the pair of casting rolls to form a casting pool supported on the casting surfaces of the casting rolls;
c. counter rotating the casting rolls to form solidified metal shells on the casting surfaces of the casting rolls; and
d. forming from said solidified shells thin steel strip downwardly through the nip between the casting rolls.

The average manganese to silicon ratio in the molten low carbon steel introduced to produce the cast strip may be greater than 3.5.

The thin steel strip produced by continuous casting may have a carbon content between about 0.025% and about 0.065% by weight, or alternatively, a carbon content below about 0.035% by weight.

The thin cast strip may have a chromium content less than 1.5% by weight or less than 0.5% by weight and/or the thin cast strip may have titanium content less than 0.005% by weight.

The thin steel strip may be less than 5 mm in thickness, or less than 2.5 mm in thickness.

The molten metal in the casting pool may have a total oxygen content of at least 100 ppm and a free oxygen content between 30 and 50 ppm. Alternatively or in addition, the thin steel strip produced by continuous casting may be from the molten metal in the casting pool having a nitrogen content less than about 52 ppm. Alternatively or in addition, the sum of the partial pressures of the hydrogen and nitrogen is less than 1.15 atmospheres.

Alternatively, disclosed is a method of casting thin steel strip comprising:

a. assembling a pair of internally cooled casting rolls having a nip therebetween and with confining closures adjacent the ends of the nip;

b. introducing molten carbon steel having a carbon content of between about 0.010% and about 0.065% by weight, less than 5.0% by weight chromium, at least 70 ppm of total oxygen and between 20 and 70 ppm of free oxygen, and an average manganese to sulfur ratio of at least about 250 between the pair of casting rolls to form a casting pool supported on the casting surfaces of the casting rolls;

c. counter rotating the casting rolls to form solidified metal shells on the casting surfaces of the casting rolls; and d. forming from said solidified shells thin steel strip downwardly through the nip between the casting rolls.

The average manganese to silicon ratio in the molten low carbon steel introduced in the method to produce cast strip may be greater than 3.5.

A thin steel strip produced by the method of casting steel strip may have a carbon content between about 0.010% and about 0.065% by weight.

The thin cast strip produced by the method may have a chromium content less than 1.5% by weight or less than 0.5% by weight and/or the thin cast strip may have titanium content less than 0.005% by weight.

The thin steel strip may be less than 5 mm in thickness, or less than 2.5 mm in thickness.

We have also found that additional variables that effect solidification and 'strength' of the newly formed shells are the temperature of the molten metal in the tundish and casting speed. Reduced temperature of the molten metal in tundish and cast speeds allows time for shell growth to larger thickness and more strength reducing microcracking adjacent to the surface of the cast strip. We have found that the thin steel strip produced by continuous casting may be cast at a tundish temperature for the molten metal below 1612° C. (2933.7° F.) and a casting speed less than 76.88 meters per minute. These additional variables are relevant to both the thin cast strip produced as well as the method by which the thin cast strip is produced.

BRIEF DESCRIPTION OF THE DRAWINGS

FIGS. 24 and 25 shows the microcracking can be turned off and on depending on the of ratio of Mn/S and Mn/Si reported in Heat Nos. 175406 and 175408 in Table I.

DETAILED DESCRIPTION OF THE DRAWINGS

Microcracking (generally referred to as "cracking") is a defect that may appear in the surface portions of thin cast strip. Cracking may result from the formation of voids, surface cavities or depressions, or inclusions adjacent the surface of the strip. Cracking may occur during the formation and cooling process.

Figure 1:
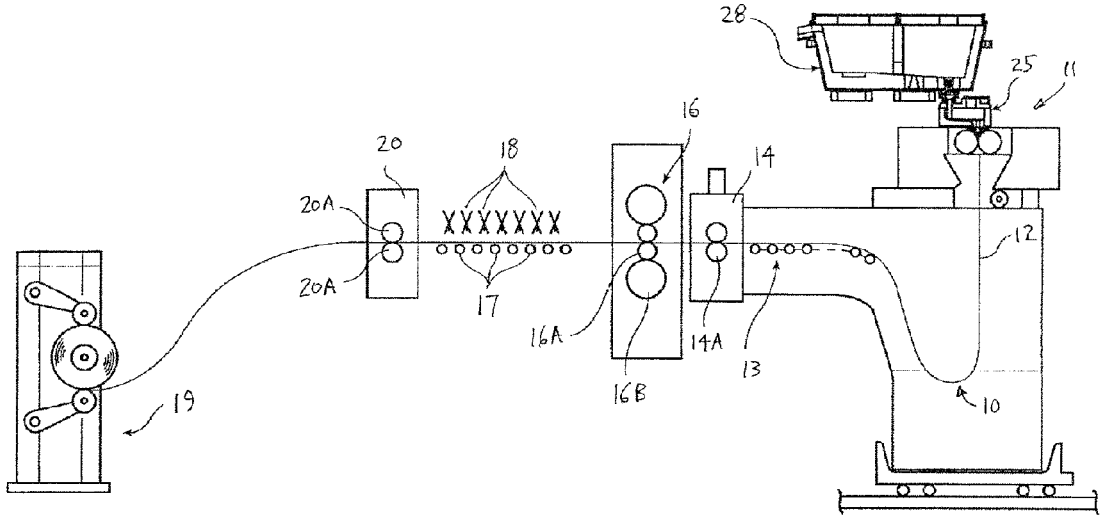
FIG. 1 is a diagrammatic side elevation view of an illustrative strip caster.
Figure 2:
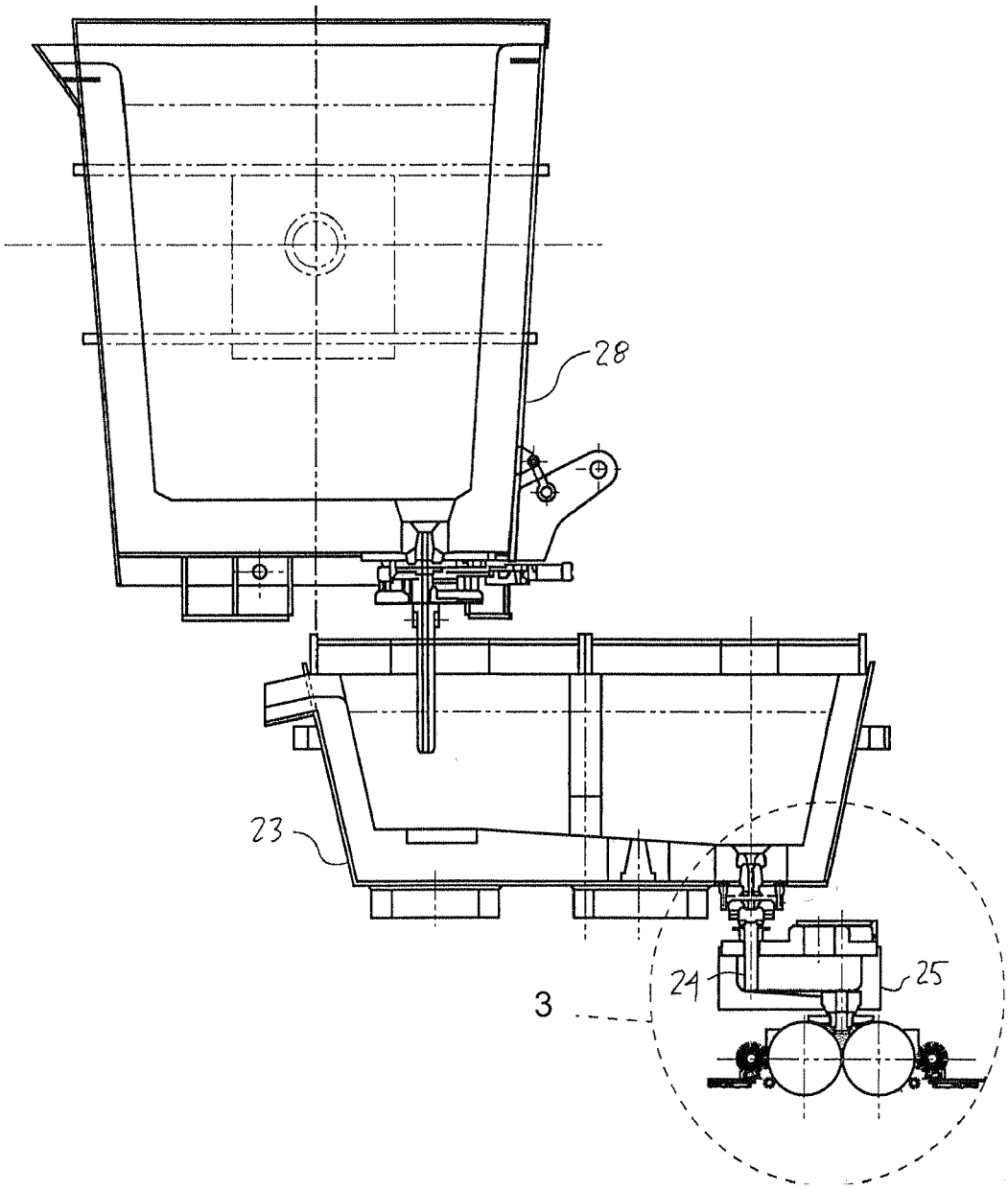
FIG. 2 is an enlarged sectional view of a portion of the caster of FIG. 1.
Figure 3:
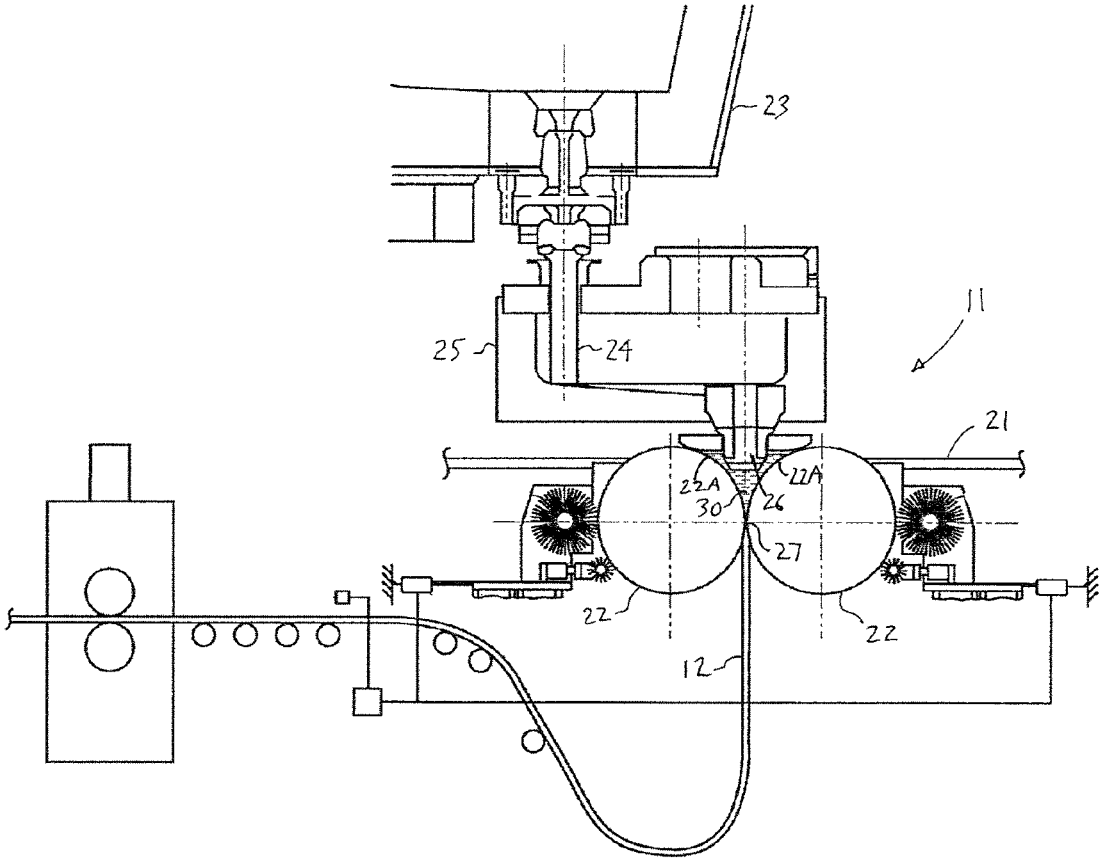
FIG. 3 is an enlarged sectional view of a portion of the caster of FIGS. 1 and 2.

Referring to FIGS. 1 through 3, the thin cast strip, and method of making the same, may be made and used in the continuous strip caster shown. FIGS. 1 through 3 illustrates a twin roll caster denoted generally as 11 which produces a cast steel strip 12 that passes in a transit path 10 across a guide table 13 to a pinch roll stand 14 comprising pinch rolls 14A. Immediately after exiting the pinch roll stand 14, the strip may pass into a hot rolling mill 16 comprising a pair of reduction rolls 16A and backing rolls 16B by in which it is hot rolled to reduce its thickness. The rolled strip passes onto a run-out table 17 on which it may be cooled by convection by contact with water supplied via water jets 18 (or other suitable means) and by radiation. In any event, the rolled strip may then pass through a pinch roll stand 20 comprising a pair of pinch rolls 20A and thence to a coiler 19. Final cooling (if necessary) of the strip takes place on the coiler.

As shown in FIGS. 2 and 3, twin roll caster 11 comprises a main machine frame 21 which supports a pair of cooled casting rolls 22 having casting roll surfaces 22A, assembled side-by-side with a nip between them. Molten metal of plain carbon steel may be supplied during a casting operation from a ladle 28 to a tundish 23, through a refractory shroud 24 to a distributor 25 and thence through a metal delivery nozzle 26 generally able the nip 27 between the casting rolls 22. The molten metal thus delivered to the nip 27 forms a pool 30 supported on the casting roll surfaces 22A above the nip and this pool is confined at the ends of the rolls by a pair of side closures, dams or plates (not shown), which may be positioned adjacent the ends of the rolls by a pair of thrusters (not shown) comprising hydraulic cylinder units (or other suitable means) connected to the side plate holders. The upper surface of pool 30 (generally referred to as the "meniscus" level) may rise above the lower end of the delivery nozzle so that the lower end of the delivery nozzle is immersed within this pool.

Casting rolls 22 are internally water cooled so that shells solidify the moving casting surfaces of the rolls. The shells are then brought together at the nip 27 between the casting rolls sometime with molten metal between the shells, to produce the solidified strip 12 which is delivered downwardly from the nip.

Frame 21 supports a casting roll carriage which is horizontally movable between as assembly station and a casting station.

Casting rolls 22 may be counter-rotated through drive shafts (not shown) driven by an electric, hydraulic or pneumatic motor and transmission. Rolls 22 have copper peripheral walls formed with a series of longitudinally extending and circumferentially spaced water cooling passages supplied with cooling water. The rolls may typically be about 500 mm in diameter and up to about 2000 mm long in order to produce strip product of about 2000 mm wide.

Tundish 23 is of conventional construction. It is formed as a wide dish made of a refractory material such as for example magnesium oxide (MgO). One side of the tundish receives molten metal from the ladle.

Delivery nozzle 26 is formed as an elongate body made of a refractory material such as for example alumina graphite. Its lower part is tapered so as to converge inwardly and downwardly above the nip between casting rolls 22.

Nozzle 26 may have a series of horizontally spaced generally vertically extending flow passages to produce a suitably low velocity discharge of molten metal throughout the width of the rolls and to deliver the molten metal between the rolls onto the roll surfaces where initial solidification occurs. Alternatively, the nozzle may have a single continuous slot outlet to deliver a low velocity curtain of molten metal directly into the nip between the rolls and/or the nozzle may be immersed in the molten metal pool.

The pool is confined at the ends of the rolls by a pair of side closure plates that are adjacent to and held against stepped ends of the rolls when the roll carriage is at the casting station. Side closure plates are illustratively made of a strong refractory material, for example boron nitride, and have scalloped side edges to match the curvature of the stepped ends of the rolls. The side plates can be mounted in plate holders which are moveable at the casting station by actuation of a pair of hydraulic cylinder units (or other suitable means) to bring the side plates into engagement with the stepped ends of the casting rolls during a casting operation.

The twin roll caster may be the kind illustrated and described in some detail in, for example, U.S. Pat. Nos. 5,184,668; 5,277,243; 5,488,988; 5,934,359; and/or 7,594,533; and International Patent Application PCT/AU93/00593, the disclosures of which are incorporated herein by reference. Reference may be made to those patents for appropriate constructional details but forms no part of the present invention.

Figure 4:
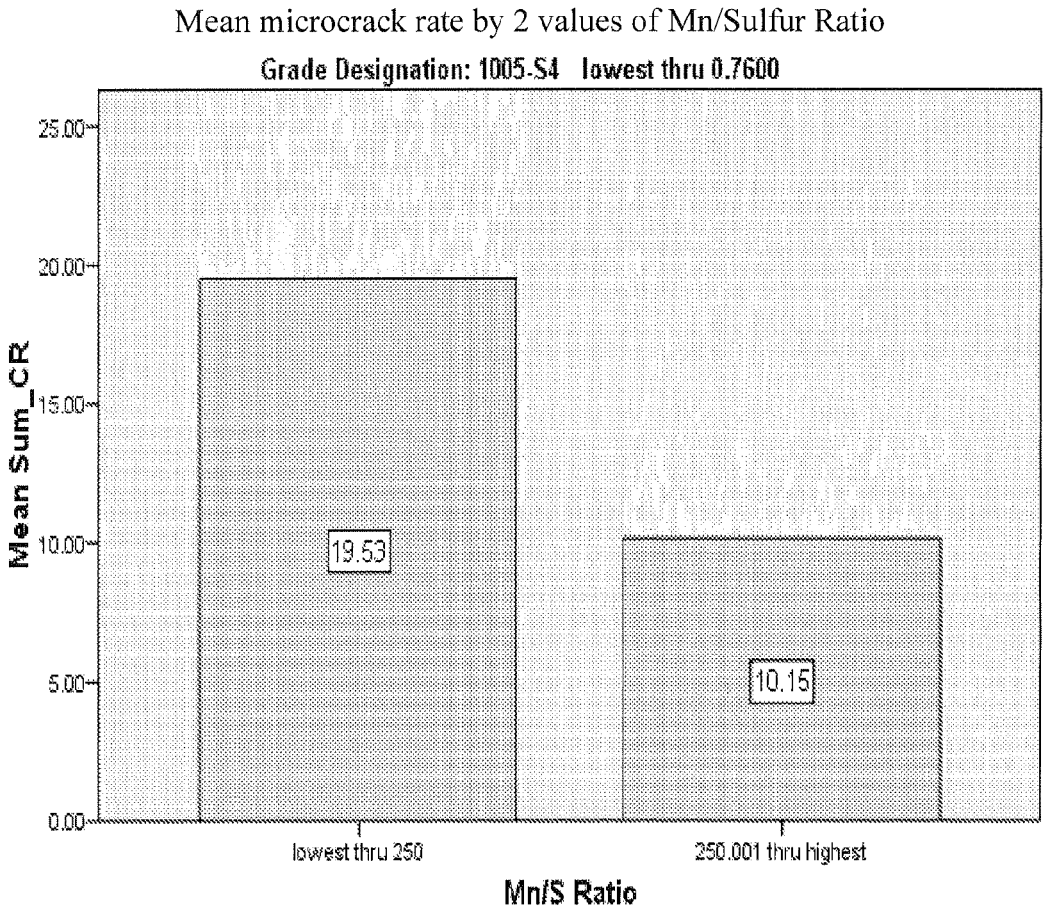
FIG. 4 shows the reduction in microcracking with manganese to sulfur ratios above 250 in a steel composition made into cast strip by a caster similar to that shown in FIGS. 1 through 3.
Figure 5:
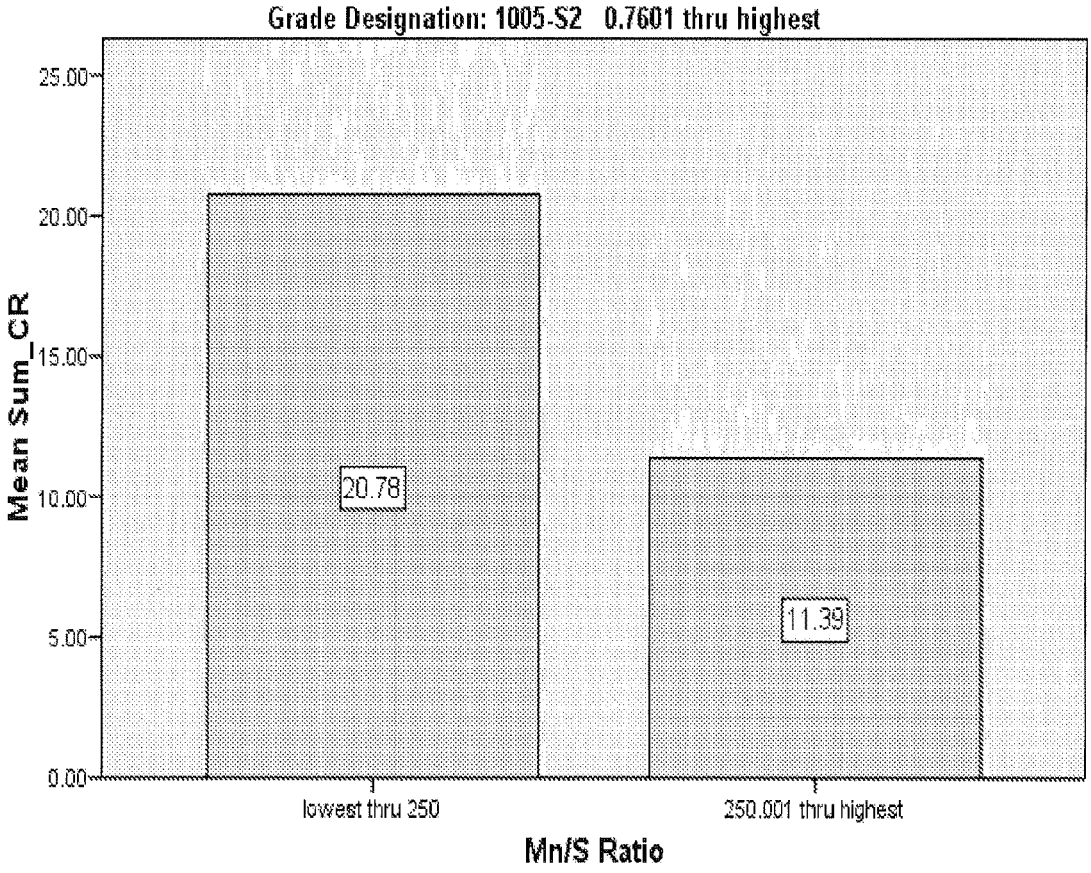
FIG. 5 shows the reduction in microcracking with manganese to sulfur ratios above 250 in a second steel composition made into cast strip by a caster similar to that shown in FIGS. 1 through 3.

Referring to FIGS. 4 and 5, the result of the mean rate of microcracking ("mean sum CR") in the surfaces of cast thin strip of two grades of steel show the response of the manganese to sulfur ratio. The steel compositions are of grade designation 1005-S4 having 0.035% carbon, 0.68% manganese, 0.20% silicon and 0.015% chromium, and grade designation 1005-S2 having 0.035% carbon, 0.85% manganese, 0.25% silicon and 0.015% chromium. The total oxygen content of the steel composition was >100 ppm and free oxygen content was 43 ppm, and the nitrogen content was 43 ppm as measured in the tundish 23 for convenience. And the partial pressures of hydrogen and nitrogen was <1.15 atmospheres. The steel strip produced was made by a twin roll caster similar to that illustrated in FIGS. 1 through 3.

During crack assessment the top and bottom surfaces of the strip are each divided into 7 areas (14 areas for 2 sides) and a crack rating is given for each area. The crack rating for each area may range from "0" (for essentially defect free strip) to "5", where "1" is less than 5 microcracks, "2" is between 5 and 24 microcracks, "3" is between 24 and 42 microcracks, "4" is between 42 and 60 microcracks, and "5" is greater than 60 microcracks in the strip. The overall crack rating "CR" is the sum of the crack rating of all 14 areas of the strip. As shown in FIGS. 4 and 5, mean sum of microcracks in the surfaces of the thin strip having a manganese to sulfur ratio lower than 250 was 19.53 on grade 1005-S4 and was 20.78 for the grade 1005-S2, respectively. By contrast the mean sum of microcracks in the cast strip with manganese to sulfur ratio above 250 was 10.15 and 11.39, respectively, in the two grades of steel in FIGS. 4 and 5.

This analysis verified that the microcracking in the cast thin strip, and the method of making the same, was much reduced in different steel compositions with a manganese/silicon ratio above 250.

Figure 6:
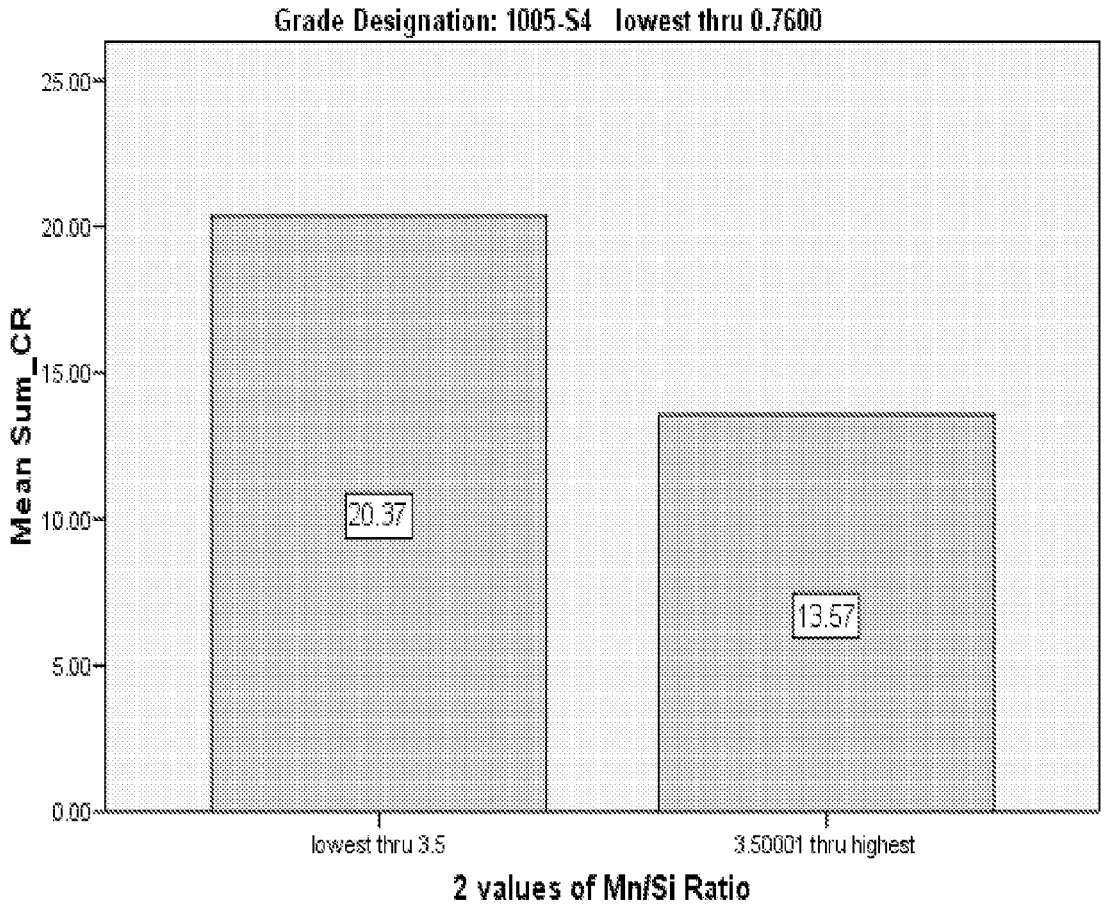
FIG. 6 shows the reduction in microcracking with manganese to silicon ratios above 3.5 in a steel composition made into cast strip by a caster similar to that shown in FIGS. 1 through 3.
Figure 7:
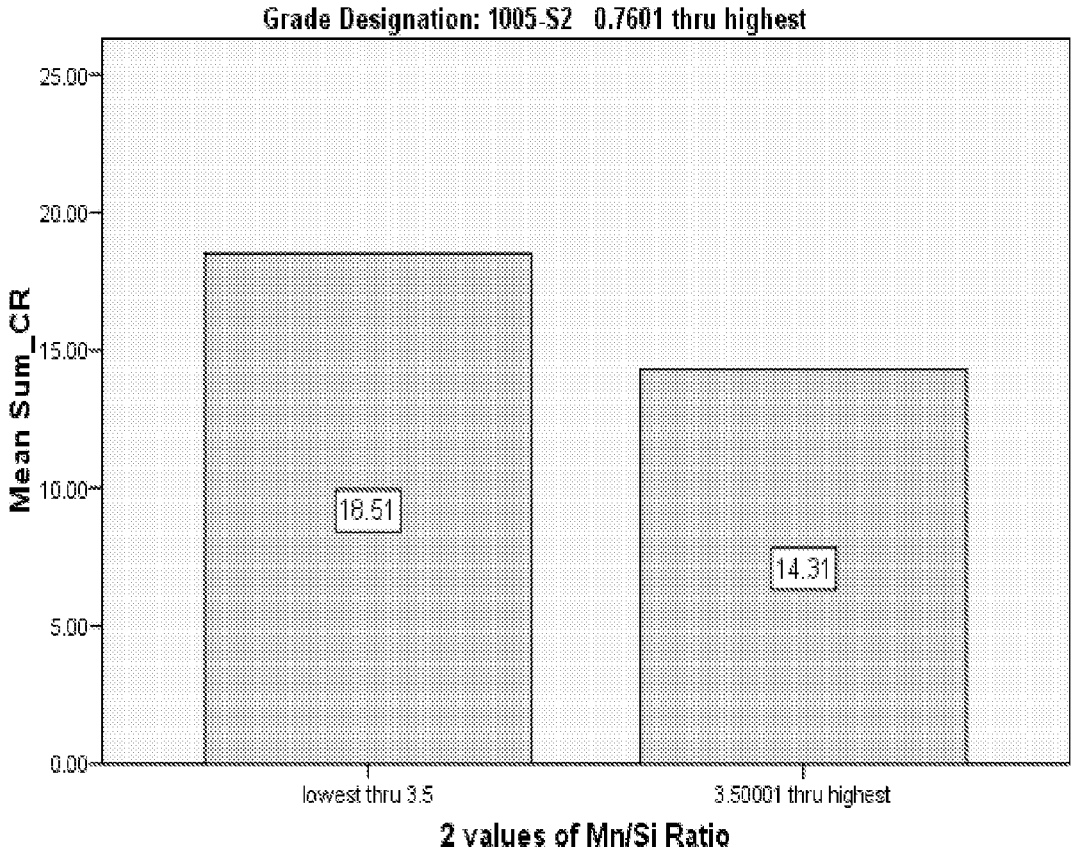
FIG. 7 shows the reduction in microcracking with manganese to silicon ratios above 3.5 in a second steel composition made into cast strip by a caster similar to that shown in FIGS. 1 through 3.

Referring to FIGS. 6 and 7, a similar analysis was done with regard to the same steel compositions of grade designations 1005-S4 and 1005-S2 on effect of microcracking ("mean sum CR") with manganese to silicon ratios above and below 3.5. As shown in FIGS. 6 and 7, the mean sum of microcracking in the surfaces of the thin cast strip for a manganese to silicon ratio below 3.5 were mean sums of 20.37 and 18.51 in the two steel grades, compared to the mean sums of microcracking of 13.57 and 14.31 in the two different steel grades with manganese to silicon ratios above 3.5. Here again, the benefit of the cast thin strip, and method of making the same, was verified with a manganese to silicon ratio above 3.5 in different steel compositions.

The benefits of the present cast strip, and method of making the same, are also illustrated in the heats 175404, 175406 and 175408 reported in Table I below in percent by weight. Heats 175404 and 175406 produced steel with surface microcracks and heat 175408 produced steel without surface microcracks.

TABLE I

| Heat | Carbon | Cu | Cr | Ti | Mn | Si | S | N | Mn/S | Mn/Si |
|---|---|---|---|---|---|---|---|---|---|---|
| 175404 | 0.0307 | 0.0771 | 0.0425 | 0.0012 | 0.892 | 0.2164 | 0.005 | 0.0056 | 178 | 4.12 |
| 175406 | 0.0312 | 0.0534 | 0.0296 | 0.0015 | 0.7786 | 0.2634 | 0.0041 | 0.0054 | 189 | 2.95 |
| 175408 | 0.0303 | 0.0555 | 0.0231 | 0.0016 | 0.9198 | 0.2265 | 0.0029 | 0.0043 | 316 | 4.06 |

The values given in Table I are percent by weight, as are other values of element content given this application unless otherwise stated.

As shown by Table I, considerably improved results in microcracking of the surfaces of the thin strip in heat 175408 were obtained when the manganese to sulfur ratio was 316 and the manganese to silicon ratio was 4.06. The manganese, sulfur and silicon, like oxygen levels described above, were measured in the tundish 23 by known techniques.

Figure 24:
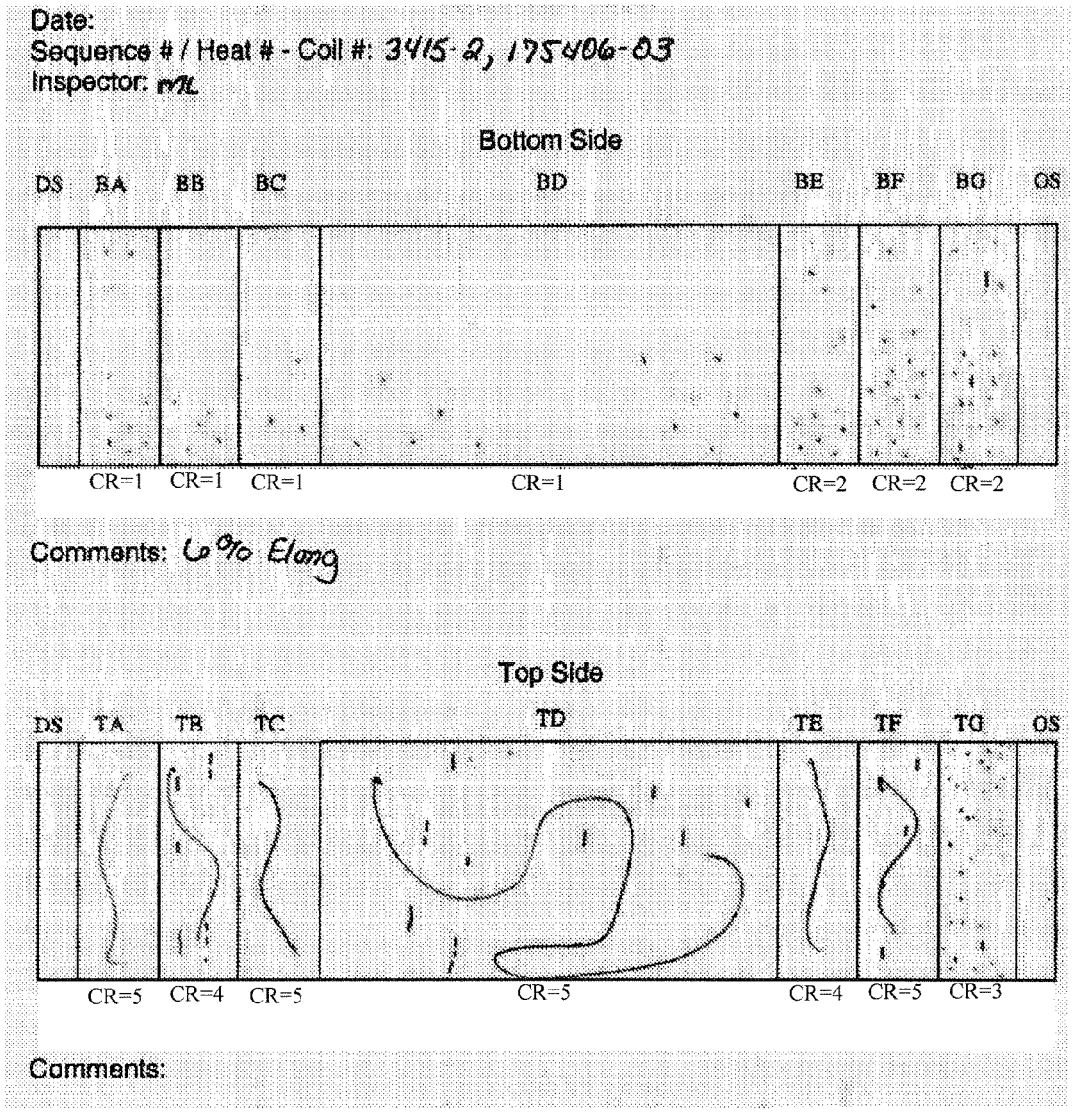

From Heats 175404, 175406, and 175408 we found it was possible to turn microcracks on and off between campaigns by varying the ratios of Mn/S and Mn/Si. When the ratio of Mn/S was below 250 and the ratio of Mn/Si was below 3.5, both the bottom and top surfaces of the cast strip showed microcracks across of the entire width of the strip as shown in FIG. 24. The sample was elongated by 6% in this analysis to assist in identifying the microcracks. TD and BD are the middle of top and bottom of the strip, DS are top and bottom of drive side edge of the strip, and OS are the top and bottom operator side edge of the strip. Three sections were also independently analyzed on both the top and bottom surfaces of the strip between the middle and edges of the strip as shown in FIG. 24. Specifically, locations XA, XB, and XC correspond to locations between locations DS and either BD or TD, where X is replaced by B or T depending on whether the location is on the bottom or the top of the strip. Similarly, locations XE, XF, and XG correspond to locations between locations BD or TD and OS, where X is again replaced by B or T depending on whether the location is on the bottom or the top of the strip. As microcracks were present in FIG. 24, the microcrack rating, "CR," of each location is presented below the corresponding segment. In contrast, when the ratio of Mn/S was above 250 and the ratio of Mn/Si was above 3.5, both the bottom and top surfaces of the cast strip were clear of microcracks as shown in FIG. 25. The sample was elongated by 4% in this analysis to assist in identifying the microcracks.

Figure 8:
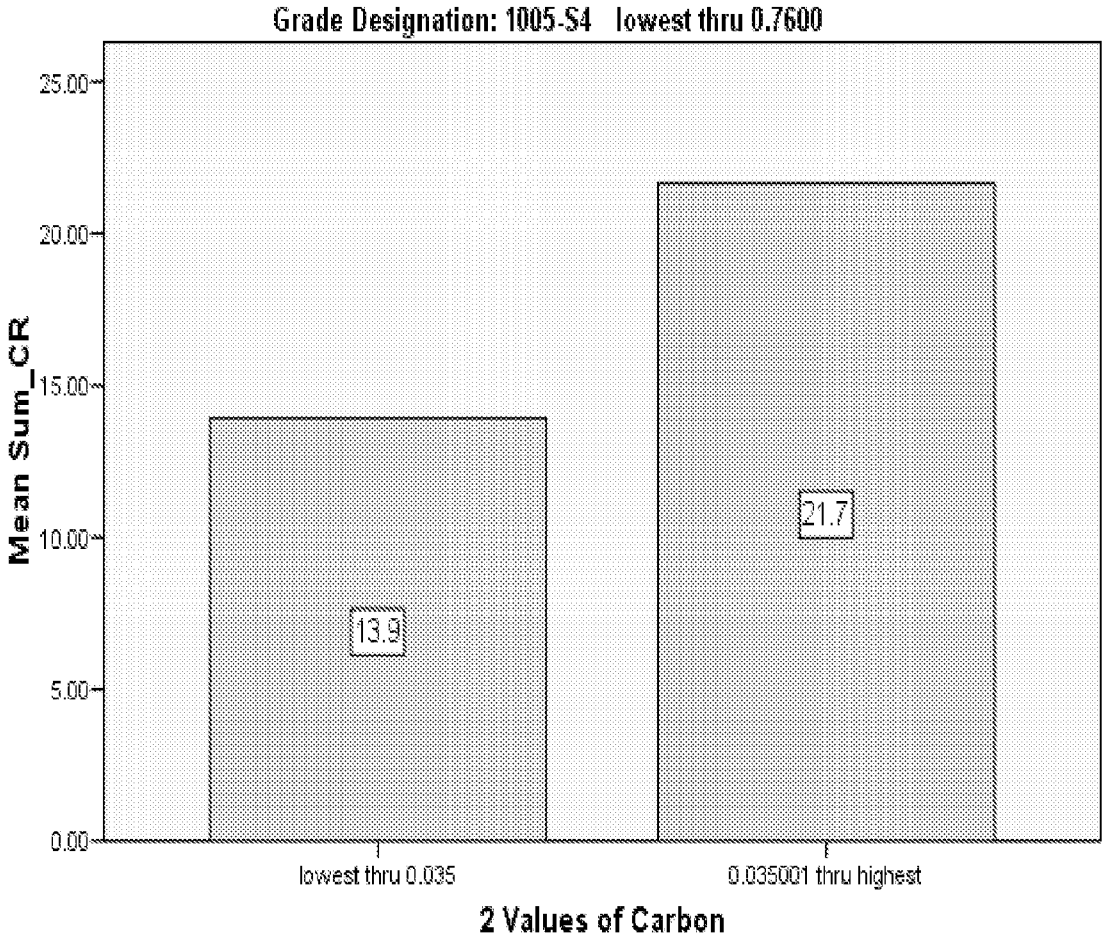
FIG. 8 shows the reduction in microcracking with carbon content below 0.035% by weight in a steel composition made into cast strip by a caster similar to that shown in FIGS. 1 through 3.
Figure 9:
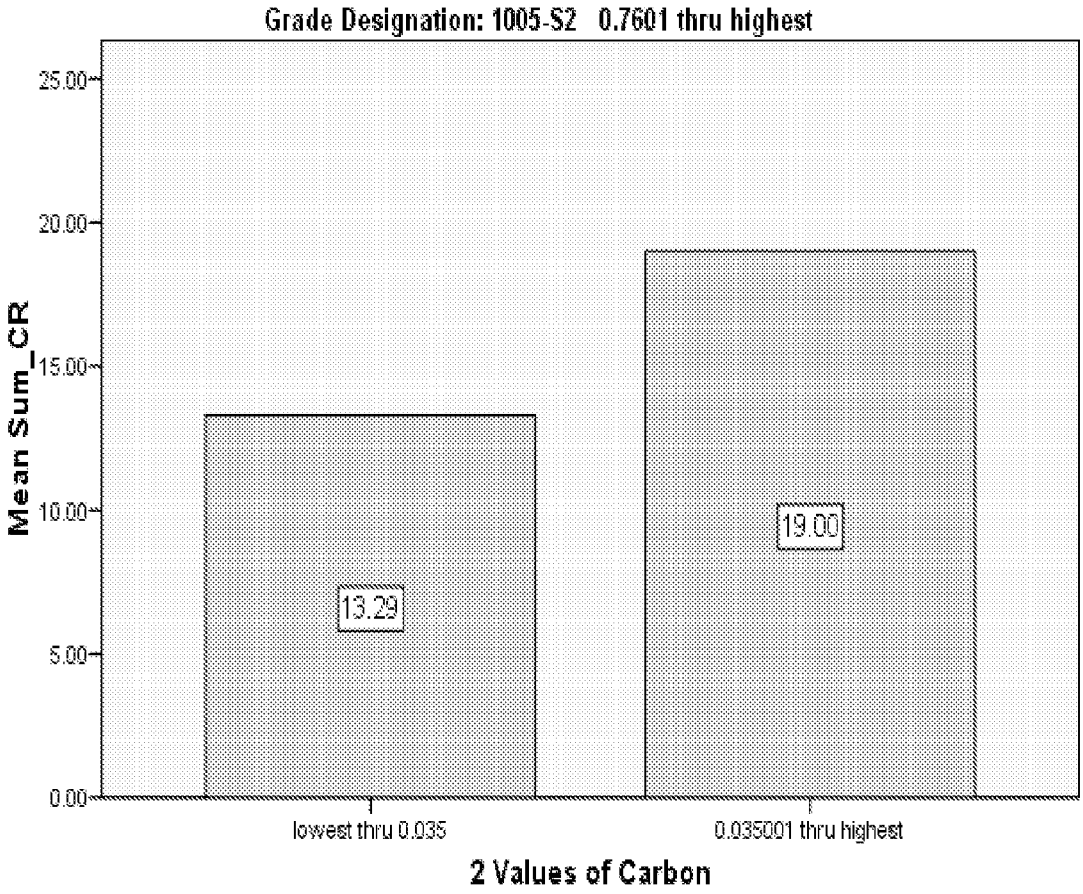
FIG. 9 shows the reduction in microcracking with carbon content below 0.035% by weight in a second steel composition made into cast strip by a caster similar to that shown in FIGS. 1 through 3.

Referring to FIGS. 8 and 9, the same two steel grades of steel composition were studied for different carbon content in the relationship to microcracking ("mean sum CR") of the surfaces of the thin strip. As shown by FIGS. 8 and 9, the mean sum of microcracks was markedly improved in both steel grades with mean sums of microcracking rates of 13.9 and 13.29, respectively, with the carbon content below 0.035% by weight, compared to mean sums of microcracking rates of 21.7 and 19.00 when the carbon exceeded 0.035% in the respective steel grades.

Figure 10:
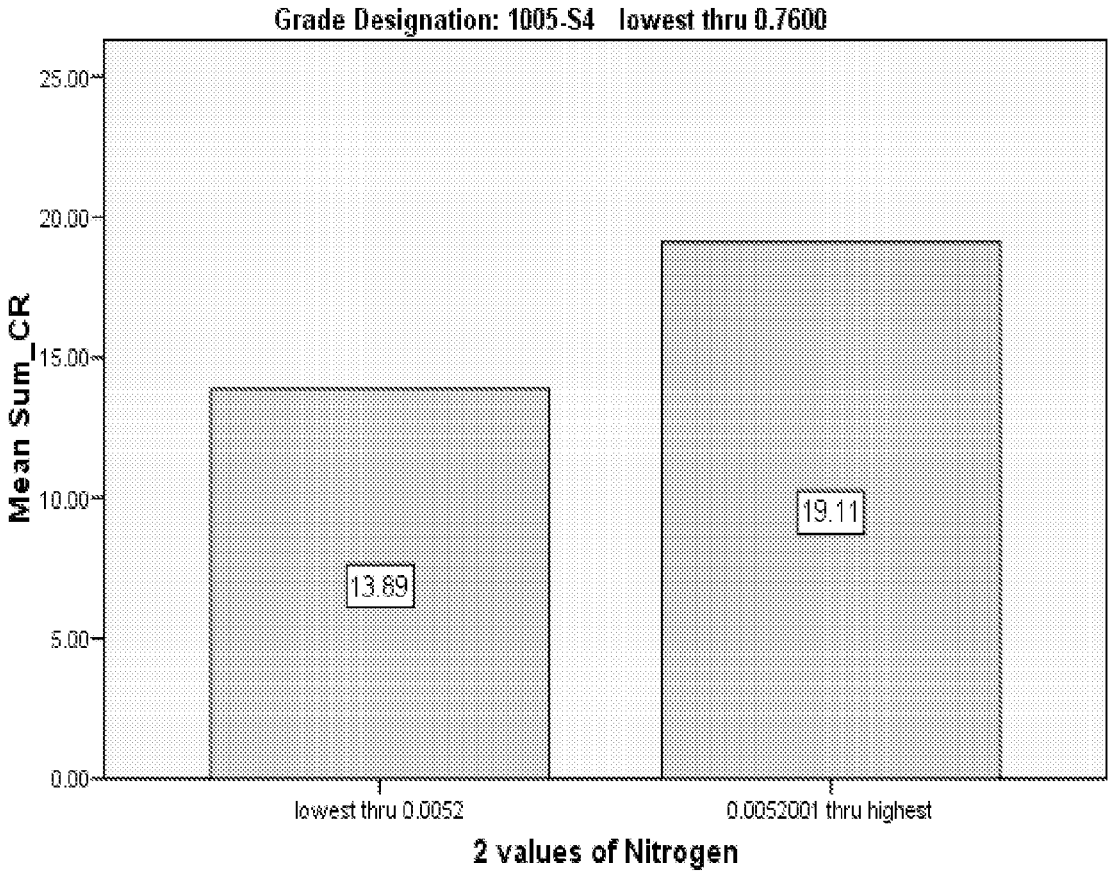
FIG. 10 shows the reduction in microcracking with nitrogen levels below 52 ppm in the molten metal prior to casting in a steel composition made into cast strip by a caster similar to that shown in FIGS. 1 through 3.
Figure 11:
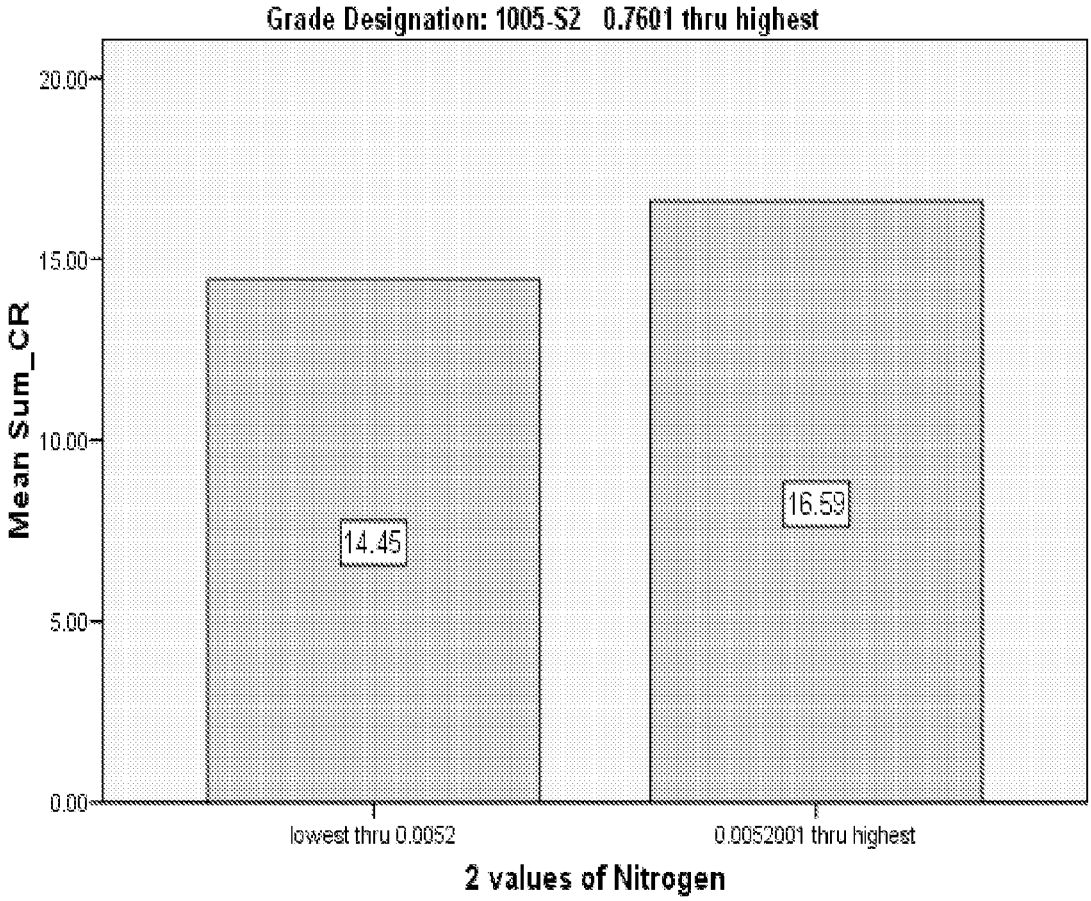
FIG. 11 shows the reduction in microcracking with nitrogen levels below 52 ppm in the molten metal prior to casting in a second steel composition made into cast strip by a caster similar to that shown in FIGS. 1 through 3.

Referring to FIGS. 10 and 11, the same two grades of steel compositions were studied for differences in the levels of nitrogen in the thin cast strip on the microcracking in the surfaces ("mean sum CR"). As shown by FIGS. 10 and 11, the microcracking was markedly improved when the nitrogen was below 0.0052% (52 ppm) by weight with the mean sum of microcracking rates 13.89 and 14.45, respectively, in the two steel grades, compared to microcracking rates of 19.11 and 16.59 when the nitrogen levels were above 0.0052% (52 ppm) by weight in the two steel grades.

Figure 12:
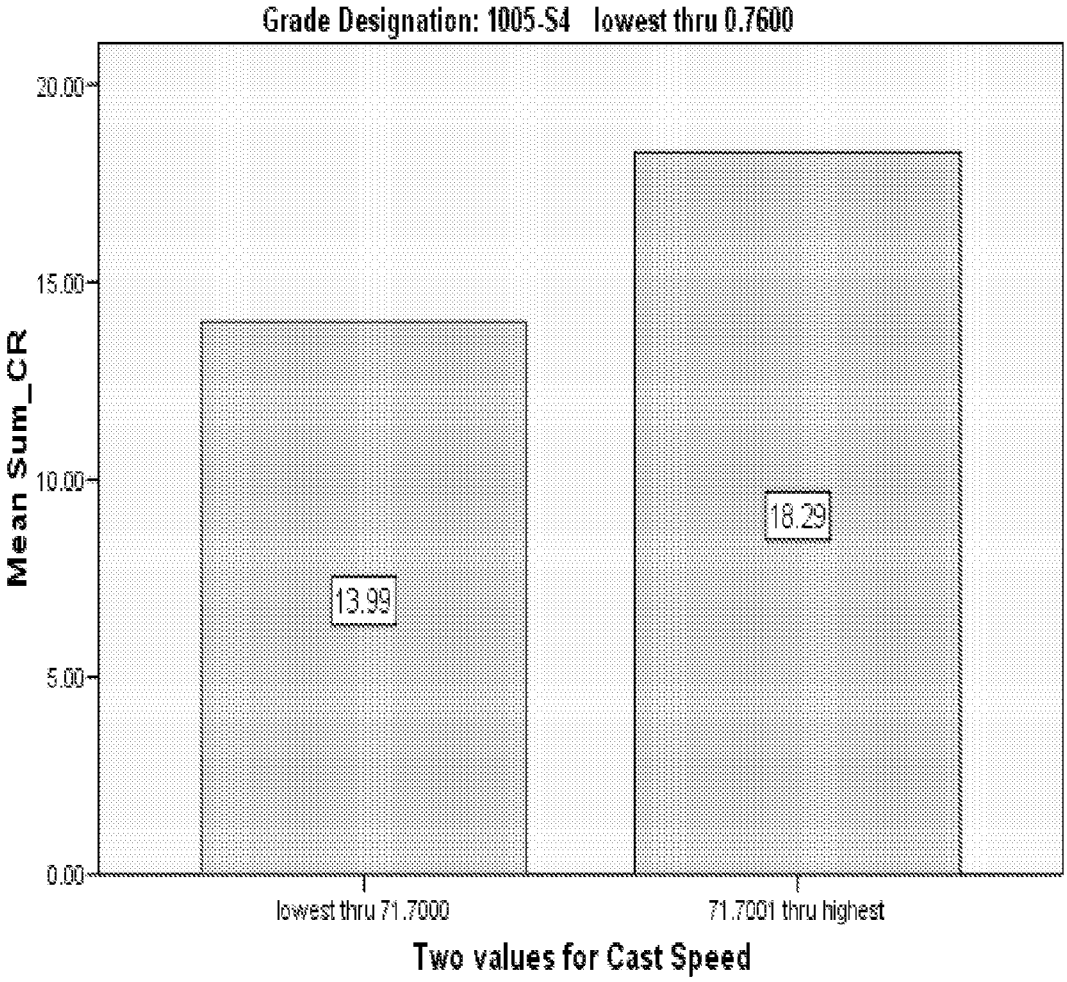
FIG. 12 shows the reduction in microcracking in a steel composition made into cast strip by a caster similar to that shown in FIGS. 1 through 3 at casting speeds below 71.8 meters per second.
Figure 13:
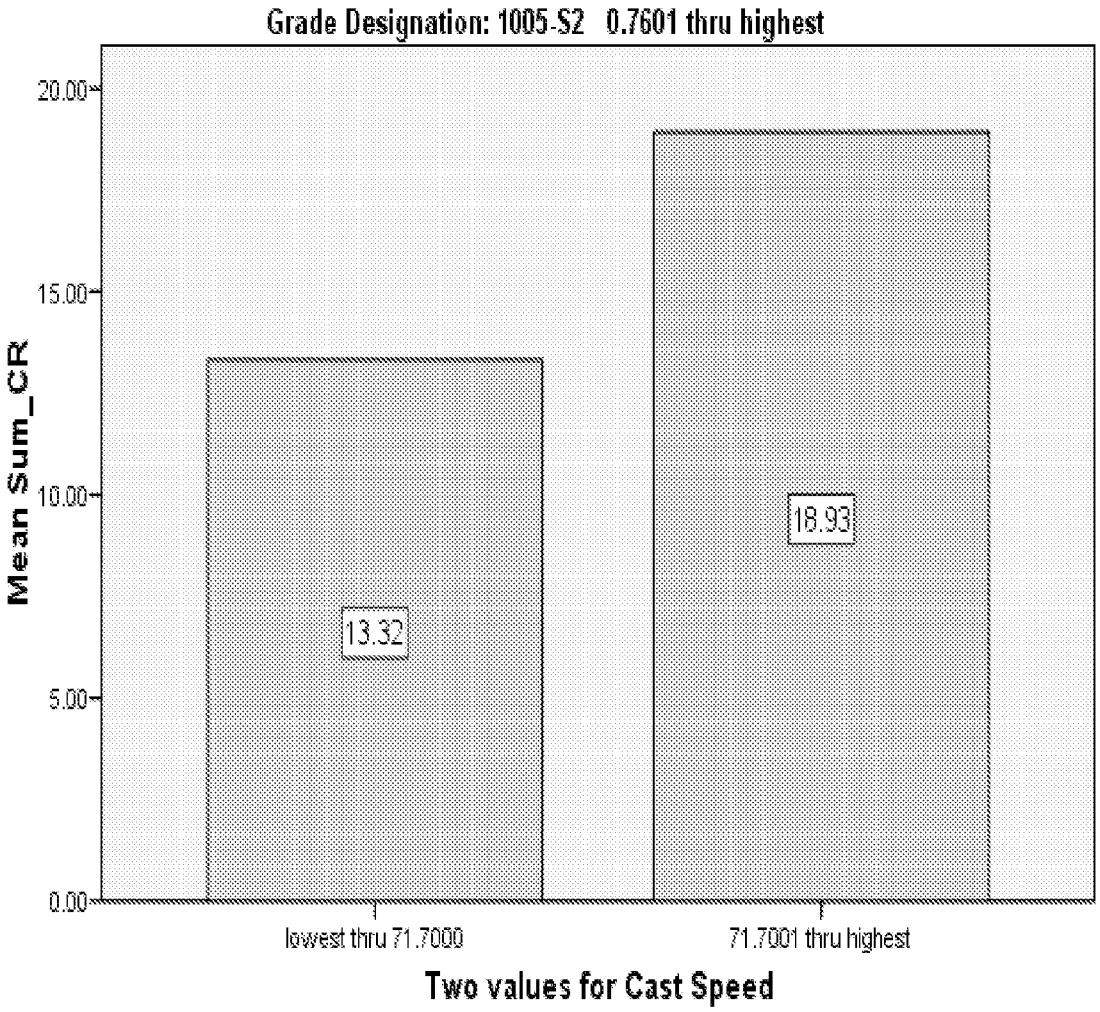
FIG. 13 shows the reduction in microcracking in a second steel composition made into cast strip by a caster similar to that shown in FIGS. 1 through 3 at casting speeds below 71.8 meters per second.

Referring to FIGS. 12 and 13, the effect of variation in casting speed on the microcracking of the surfaces of the thin cast strip was studied in the same two grades of steel. As shown by FIGS. 12 and 13, the microcracking was markedly improved, showing mean sums of microcracking rates of 13.99 and 13.32, respectively, when the casting speed was below 71.7 meters per minute, compared mean sums of microcracking rates of 18.29 and 18.93 when the casting speed was above 71.7 meters per minute.

Figure 14:
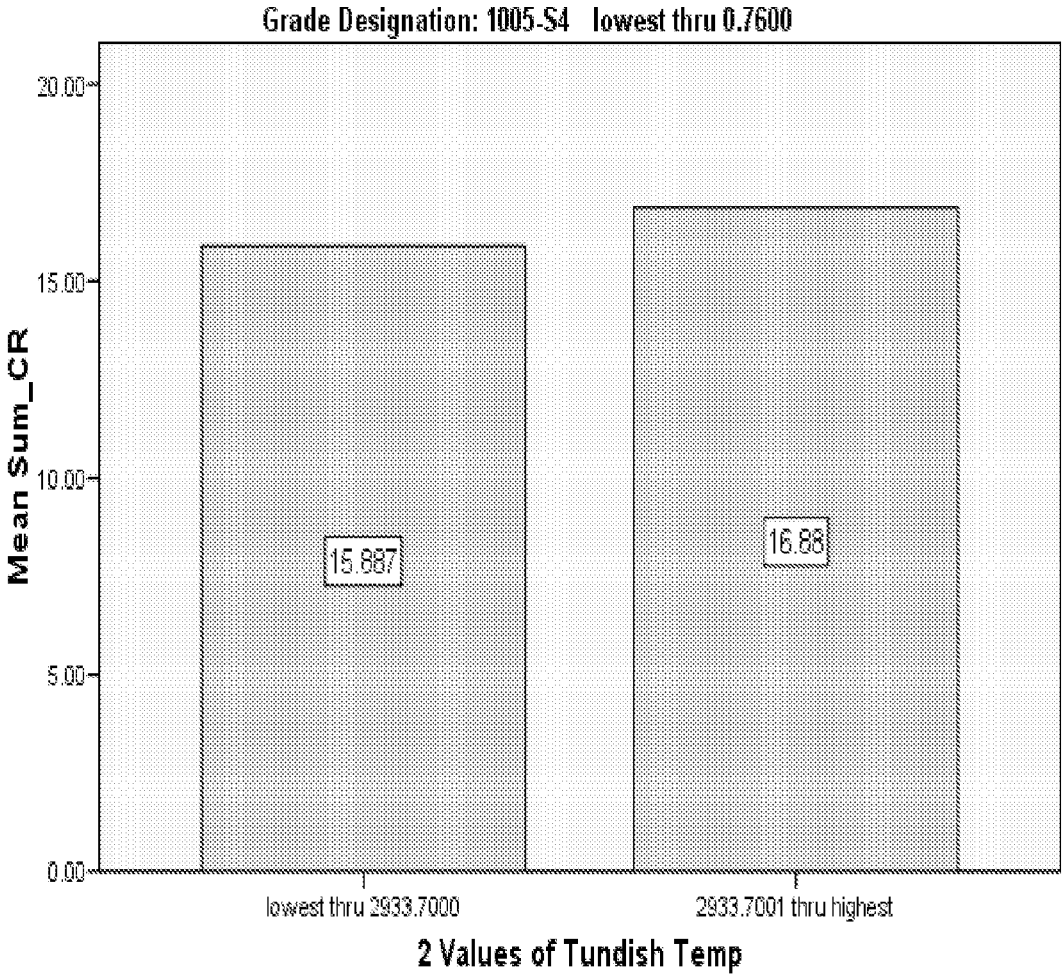
FIG. 14 shows the reduction in microcracking in a steel composition made into cast strip by a caster similar to that shown in FIGS. 1 through 3 at a tundish temperature below 1612° C. (2933.7° F.)
Figure 15:
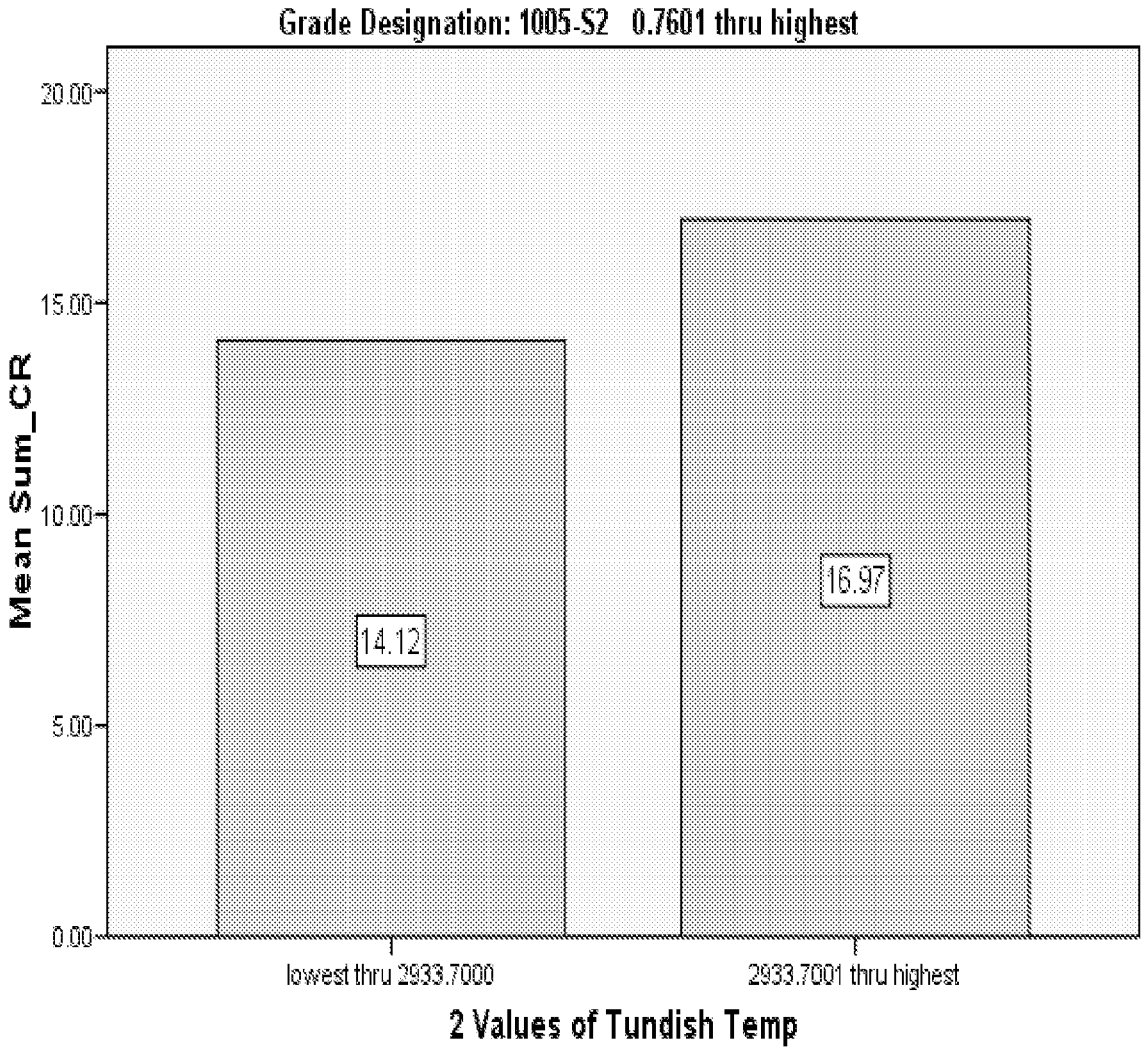
FIG. 15 shows the reduction in microcracking in a second steel composition made into cast strip by a caster similar to that shown in FIGS. 1 through 3 at a tundish temperature below 1612° C. (2933.7° F.)

Referring to FIGS. 14 and 15, the effect of variation in temperature of the molten metal in the tundish 23 on the microcracking of the surfaces of the thin cast strip was studied in the same two grades of steel. Temperature of the molten metal was measured in the tundish by a temperature probe. As shown by FIGS. 14 and 15, the microcracking was improved, showing mean sums of microcracking rates of 15.887 and 14.12, respectively, when cast at a tundish temperature of molten metal below 1612° C. (2933.7° F.) in both steel composition, compared mean sums of microcracking rates of 16.88 and 16.97 when the tundish temperature of the molten metal was above 1612° C. (2933.7° F.).

Figure 16:
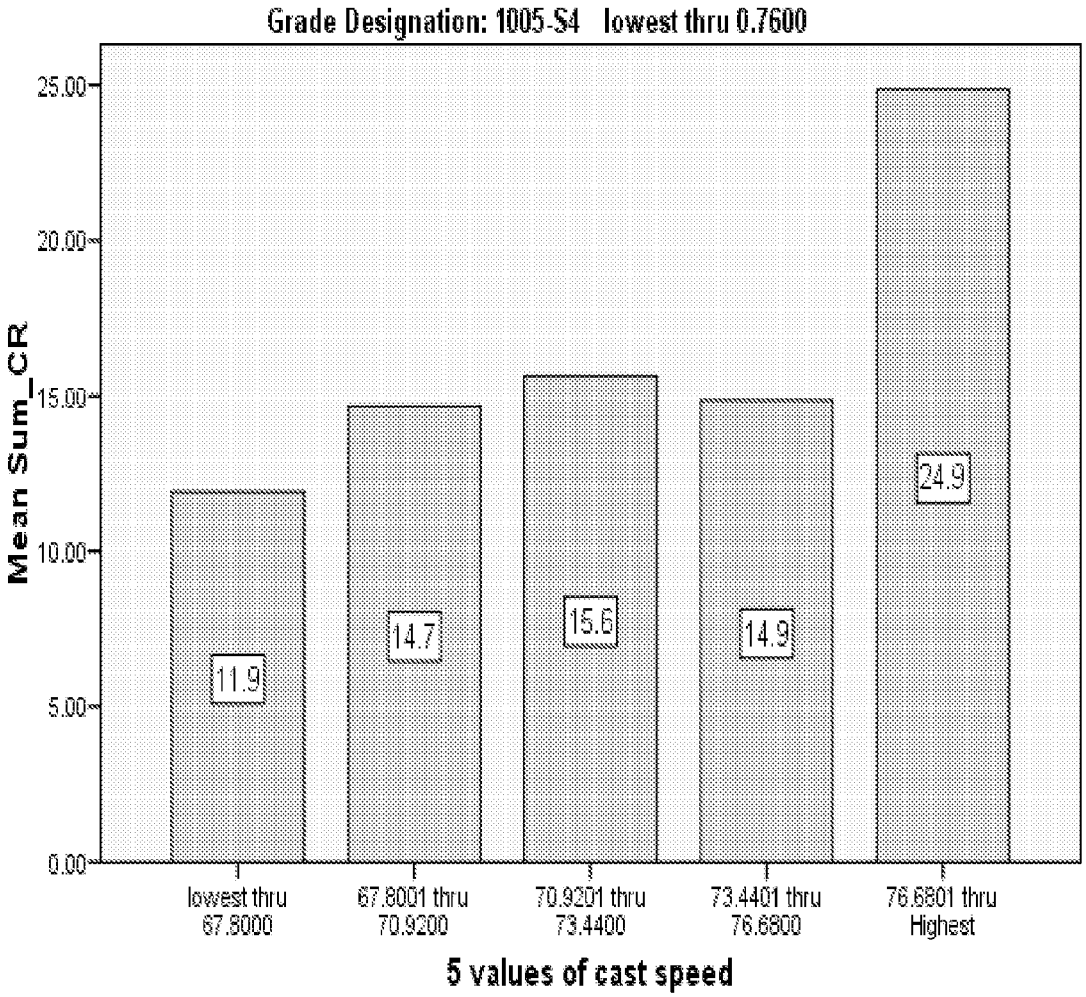
FIG. 16 shows the reduction in microcracking in a steel composition made into cast strip by a caster similar to that shown in FIGS. 1 through 3 at five different casting speeds.
Figure 17:
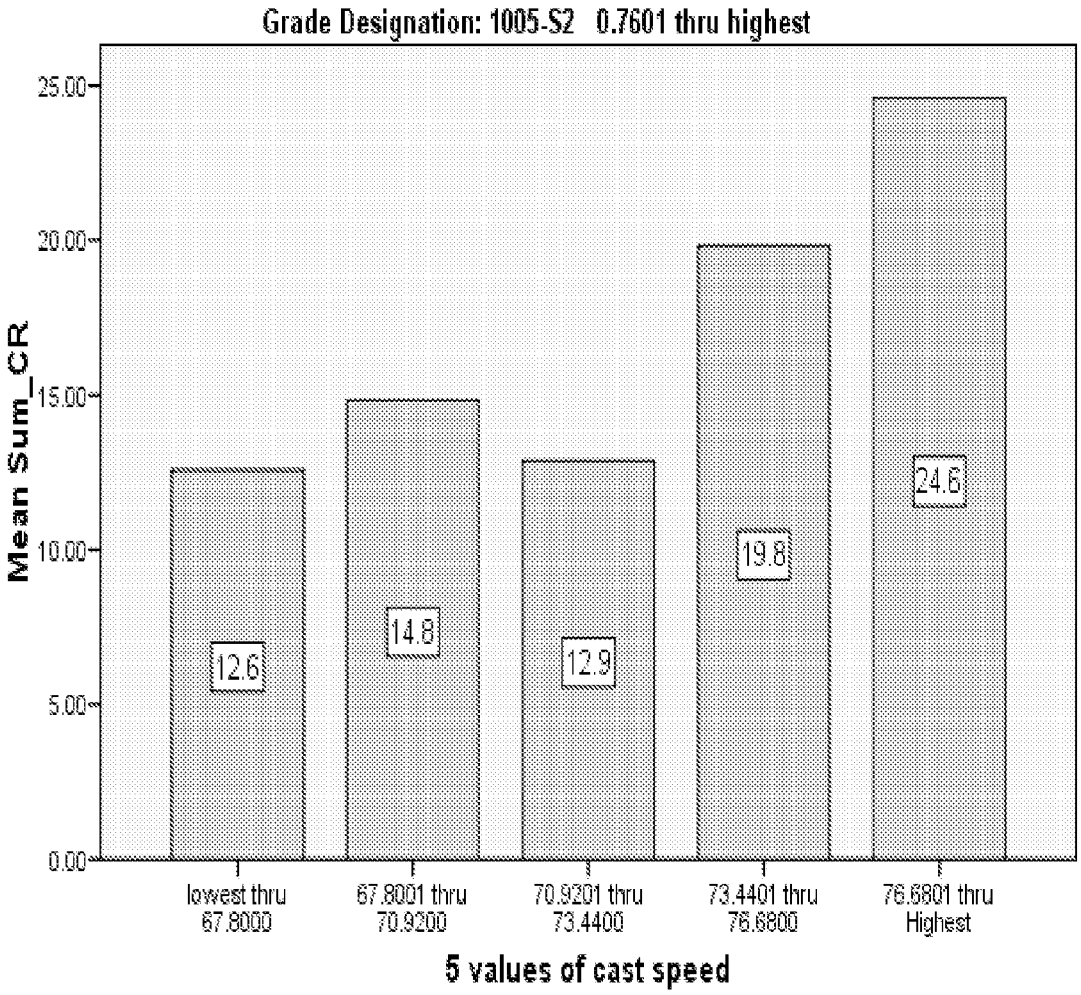
FIG. 17 shows the reduction in microcracking in a second steel composition made into cast strip by a caster similar to that shown in FIGS. 1 through 3 at the same five different casting speeds.

Referring to FIGS. 16 and 17, we further analyzed the data more detail on the effect of casting speed on the degree of microcracking in the surfaces of thin cast strip of the same composition. In this analysis, the mean sum of microcracking rates on strip were categorized at speeds below 67.8 meters per minute, between 67.8 and 70.92 meters per minute, between 70.92 and 73.44 meters per minute, between 73.44 and 76.68 meters per minute and 76.68 and higher meters per minute. As shown in FIGS. 16 and 17, the mean sum of microcracking rates was improved when the casting speed was maintained below 76.68 meters per minute in both grades of steel compositions, while microcracking markedly increased to 24.9 and 26.9 in the mean sum of microcracking rates when the casting speed was above 76.68 meters per minute.

Figure 18:
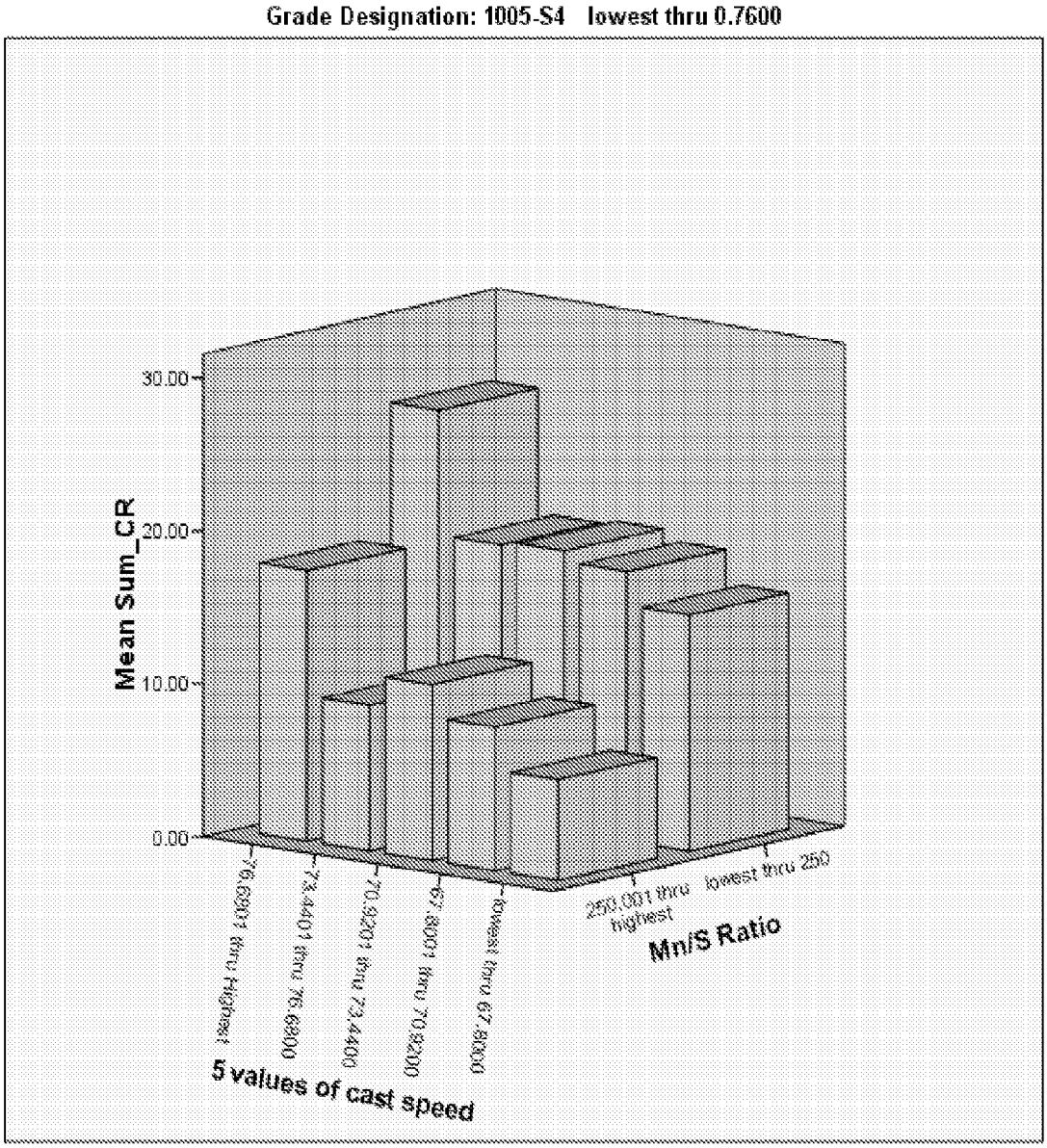
FIG. 18 shows the reduction in microcracking in a steel composition made into cast strip by a caster similar to that shown in FIGS. 1 through 3 at five different casting speeds with manganese to sulfur ratios above 250.
Figure 19:
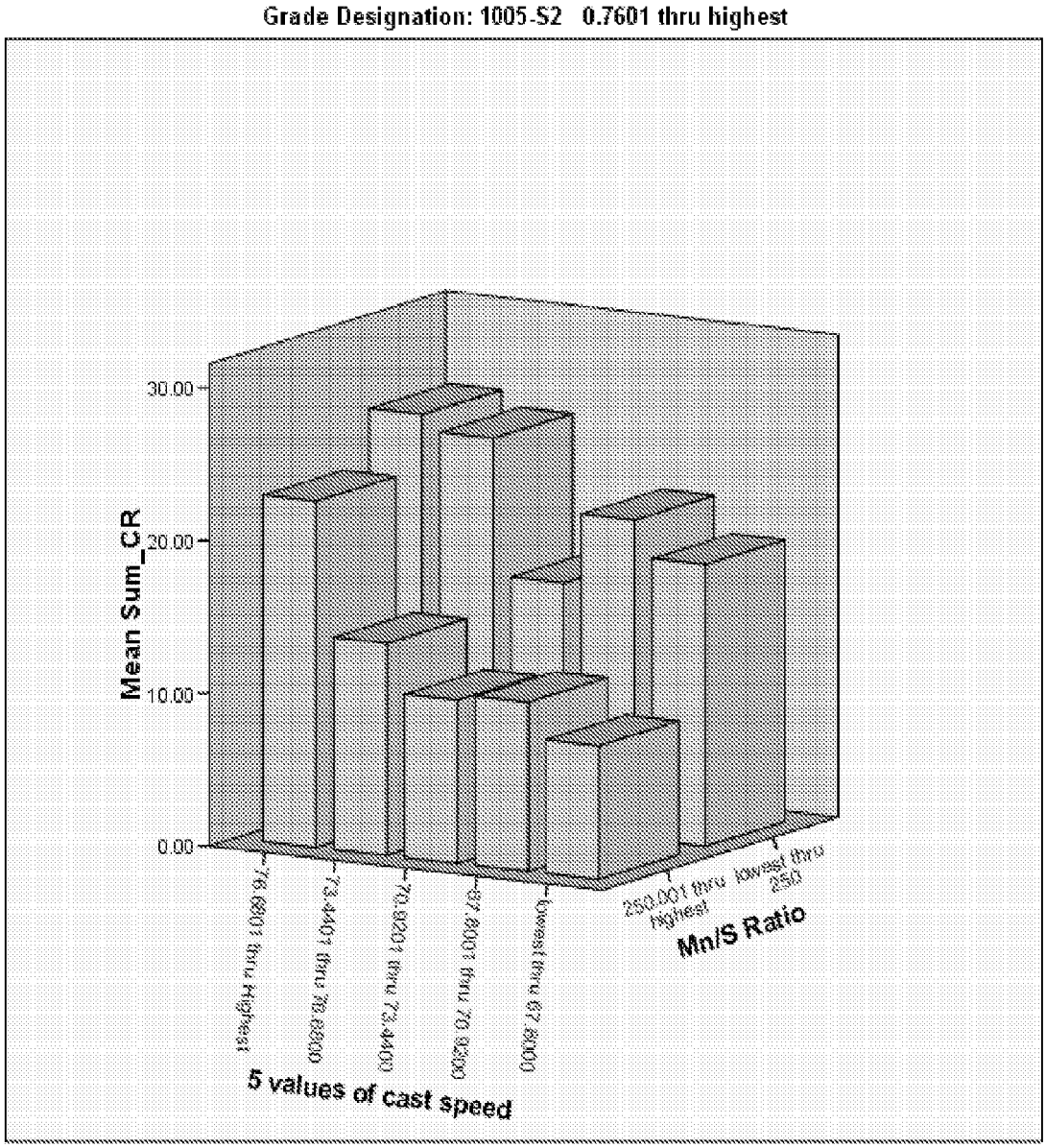
FIG. 19 shows the reduction in microcracking in a second steel composition made into cast strip by a caster similar to that shown in FIGS. 1 through 3 at five different casting speeds with manganese to sulfur ratios above 250.

Referring to FIGS. 18 and 19, the effects on microcracking in the cast strip surfaces were studied for the interrelationship of the same range speeds of casting with the ratios of manganese/sulfur above and below 250. As shown in FIGS. 18 and 19, there was a marked improvement in the mean sum of microcracking rate with manganese to sulfur ratios above 250 at all casting speeds, and particularly, when the casting speed was below 76.68 meters per minute, in both grades of steel compositions.

Figure 20:
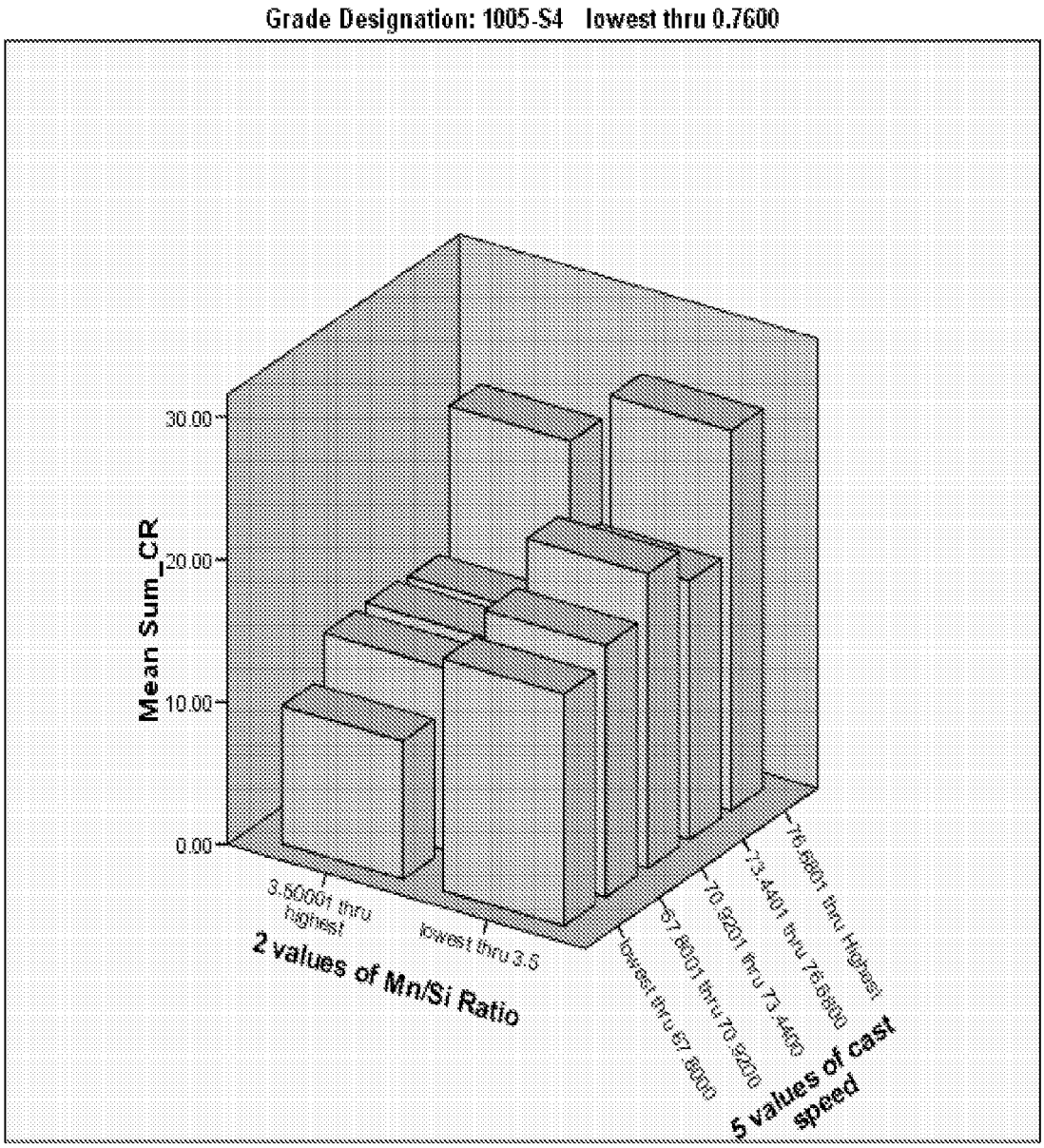
FIG. 20 shows the reduction in microcracking in a steel composition made into cast strip by a caster similar to that shown in FIGS. 1 through 3 at five different casting speeds with manganese to silicon ratios above 3.5.
Figure 21:
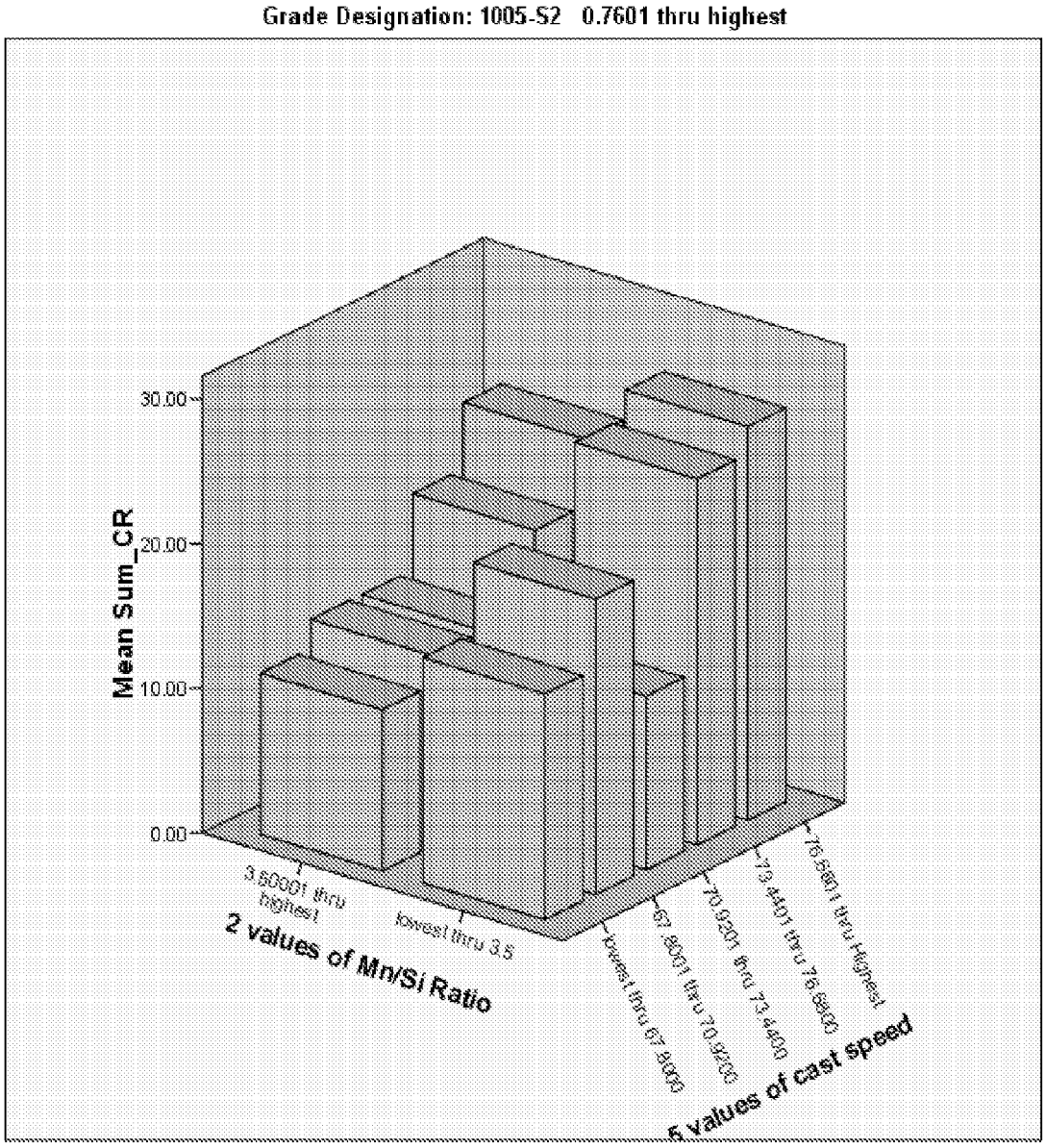
FIG. 21 shows the reduction in microcracking in a second steel composition made into cast strip by a caster similar to that shown in FIGS. 1 through 3 at five different casting speeds with manganese to silicon ratios above 3.5.

Referring to FIGS. 20 and 21, the interrelationship of the manganese/silicon ratios above and below 3.5 on microcracking rates in the cast strip surfaces with the same different casting speeds was analyzed. As shown in FIGS. 20 and 21, there was a marked improvement in the mean sums of microcracking rates at all casting speeds, when the manganese/silicon ratios were above 3.5, and particularly when it was above 3.5 with a casting speed below 76.68 meters per minute.

Figure 22:
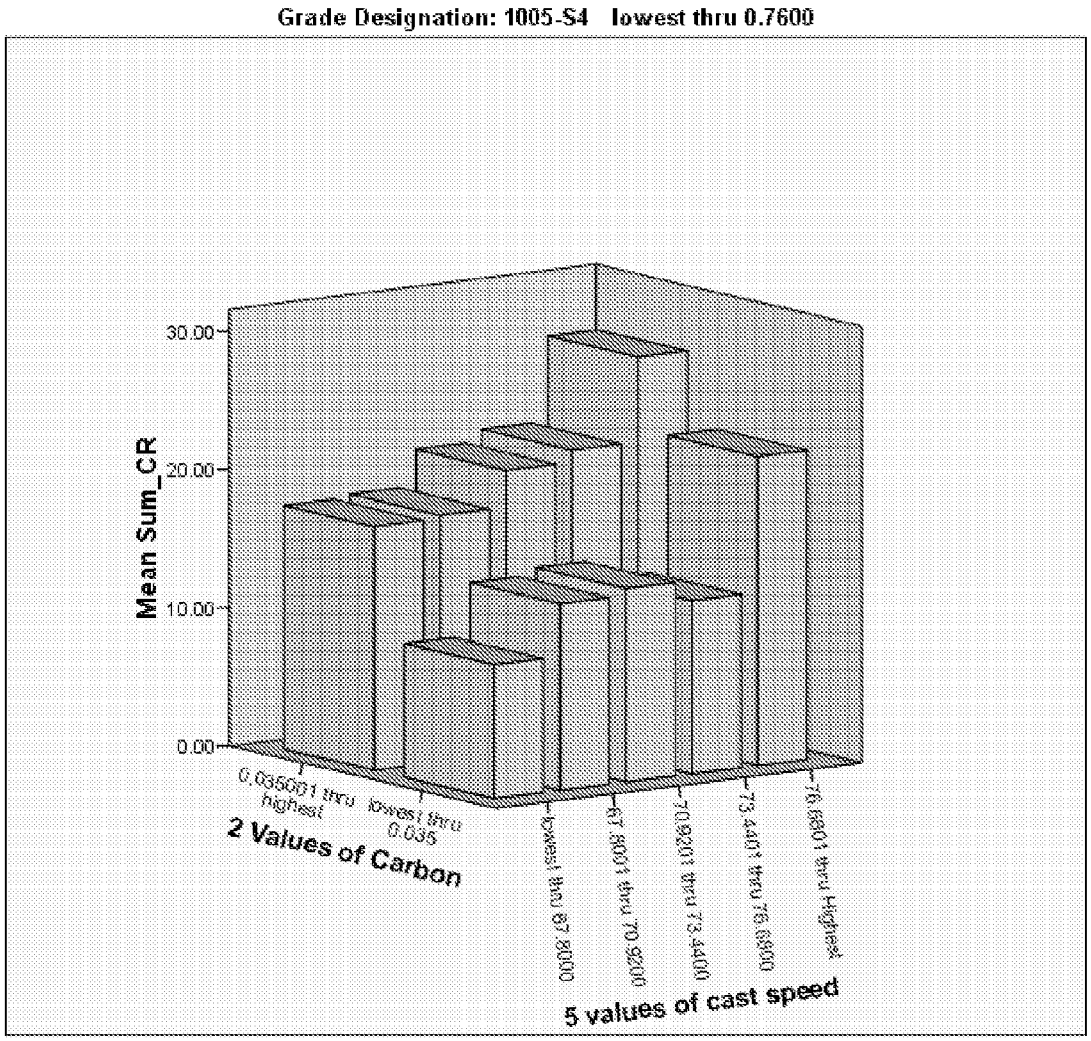
FIG. 22 shows the reduction in microcracking in a steel composition made into cast strip by a caster similar to that shown in FIGS. 1 through 3 at five different casting speeds with carbon content below 0.035% by weight.
Figure 23:
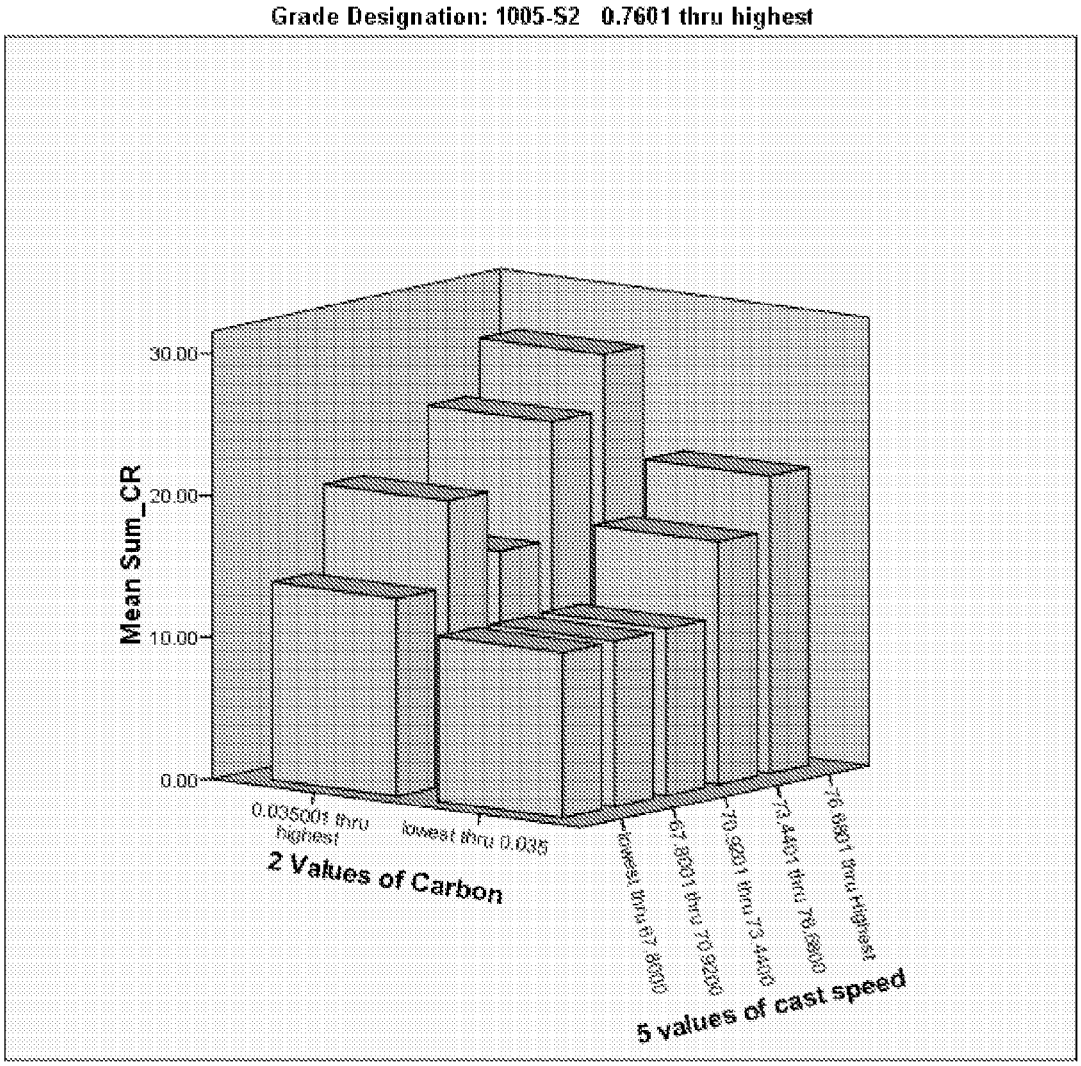
FIG. 23 shows the reduction in microcracking in a second steel composition made into cast strip by a caster similar to that shown in FIGS. 1 through 3 at five different casting speeds with carbon content below 0.035% by weight.

Referring to FIGS. 22 and 23, the interrelationship of carbon levels and casting speed for the two different designations of steel composition was studied for effect on the microcracking rates of the thin cast strip. As shown in FIGS. 22 and 23, there was a marked improvement in microcracking rates when the carbon level was below 0.035% at all casting speeds in both grades of steel compositions, and particularly when the casting speed was below 76.68 meters per minute.

We also did statistical tests on the interrelationships between the variable studied, particularly on manganese/sulfur ratio, manganese/silicon ratio, casting speed, carbon content, nitrogen content, and tundish temperature. These are reported in Table II below.

TABLE II

TESTS OF BETWEEN-SUBJECTS EFFECTS
Dependent Variable: Sum_C

| Source | Type III Sum of Squares | df | Mean Square | F | Sig. |
|---|---|---|---|---|---|
| Corrected Model | 195668.130 | 62 | 3155.938 | 22.115 | .000 |
| Intercept | 698373.579 | 1 | 698373.579 | 4893.905 | .000 |
| Nom_2_TundishTemp | 3211.298 | 1 | 3211.298 | 22.503 | .000 |
| Nom_2_Nitrogen | 2886.082 | 1 | 2886.082 | 20.224 | .000 |
| Nom_2_CastSpeed | 9880.504 | 1 | 9880.504 | 69.238 | .000 |
| Nom_2_Mn_Si_ratio | 17924.057 | 1 | 17924.057 | 125.604 | .000 |
| Nom_2_Carbon | 19607.330 | 1 | 19607.330 | 137.400 | .000 |
| Nom_2_Mn_S_Ratio | 51643.646 | 1 | 51643.646 | 361.897 | .000 |
| Nom_2_TundishTemp * Nom_2_Nitrogen | 695.302 | 1 | 695.302 | 4.872 | .027 |
| Nom_2_TundishTemp * Nom_2_CastSpeed | 1205.539 | 1 | 1205.539 | 8.448 | .004 |
| Nom_2_Nitrogen * Nom_2_CastSpeed | 739.559 | 1 | 739.559 | 5.183 | .023 |
| Nam_2_TundishTemp * Nom_2_Nitrogen * Nom_2_CastSpeed | 326.054 | 1 | 326.054 | 2185 | .131 |
| Nom_2_TundishTemp * Nom_2_Mn_Si_ratio | 3.529 | 1 | 3.529 | .025 | .875 |
| Nom_2_Nitrogen * Nom_2_Mn_Si_ratio | 9.989 | 1 | 9.989 | .070 | .791 |
| Nom_2_TundishTemp * Nom_2_Nitrogen * Nom_2_Mn_Si_ratio | 50.546 | 1 | 50.546 | .354 | .552 |
| Nom_2_CastSpeed Nom_2_Mn_Si_ratio | 1307.667 | 1 | 1307.667 | 9.164 | .002 |
| Nom_2_TundishTemp * Nom_2_CastSpeed * Nom_2_Mn_Si_ratio | 1442.565 | 1 | 1442.565 | 10.109 | .001 |
| Nom_2_Nitrogen * Nom_2_CastSpeed * Nom 2_Mn_Si_ratio | 2236.165 | 1 | 2236.165 | 15.670 | .000 |
| Nom_2_TundishTemp * Nom_2_Nitrogen * Nom_2_CastSpeed Nom_2_Mn_Si_ratio | 1.389 | 1 | 1.389 | .010 | .921 |
| Nom_2_TundishTemp * Nom_2_Carbon | 609.876 | 1 | 609.876 | 4.274 | .039 |
| Nom_2_Nitrogen * Nom_2_Carbon | 3714.569 | 1 | 3714.569 | 26.030 | .000 |
| Nom_2_TundishTemp * Nom_2_Nitrogen * Nom_2_Carbon | 152.133 | 1 | 152.133 | 1.066 | .302 |
| Nom_2_CastSpeed Nom_2_Carbon | 1692.383 | 1 | 1692.383 | 11.660 | 001 |
| Nom_2_TundishTemp * Nom_2_CastSpeed * Nom_2_Carbon | 1095.570 | 1 | 1095.570 | 7.677 | .006 |
| Nom_2_Nitrogen * Nom_2_CastSpeed * Nom_2_Carbon | .982 | 1 | .982 | .007 | .934 |
| m_2_TundishTemp * Nom_2_Nitrogen * Nom_2_CastSpeed | 1.259 | 1 | 1.259 | .009 | .925 |

TABLE II-continued

TESTS OF BETWEEN-SUBJECTS EFFECTS
Dependent Variable: Sum_C

| Source | Type III Sum of Squares | df | Mean Square | F | Sig. |
|---|---|---|---|---|---|
| Nom_2_Carbon Nom_2_Mn_Si_ratio * | 19.373 | 1 | 19.373 | .136 | .713 |
| Nom_2_Carbon Nom_2_TundishTemp * Nom_2_Mn_Si_ratio * | 368.798 | 1 | 368.798 | 2.584 | .108 |
| Nom_2_Carbon Nom_2_Nitrogen Nom_2_Mn_Si_ratio * | 1364.117 | 1 | 1364.117 | 9.559 | .002 |
| Nom_2_Carbon Nom_2_TundishTemp * Nom_2_Nitrogen * Nom_2_Mn_Si_ratio * | 743.037 | 1 | 743.037 | 5.207 | .023 |
| Nom_2_Carbon Nom_2_CastSpeed Nom_2_Mn_Si_ratio * | 573.013 | 1 | 573.013 | 4.015 | .045 |
| Nom_2_Carbon Nom_2_TundishTemp * Nom_2_CastSpeed * Nom_2_Mn_Si_ratio | 815.529 | 1 | 815.529 | 5.715 | .017 |
| Nom_2_Carbon Nom_2_Nitrogen Nom_2_CastSpeed * Nom_2_Mn_Si_ratio | 264.656 | 1 | 264.656 | 1.855 | .173 |
| Nom_2_Carbon Nom_2_TundishTemp * Nom_2_Nitrogen * Nom_2_CastSpeed * Nom_2_Mn_Si_ratio | 200.957 | 1 | 200.957 | 1.408 | .235 |
| Nom_2_Carbon Nom_2_TundishTemp * Nom_2_Mn_S_Ratio | 146.236 | 1 | 146.236 | 1.025 | .311 |
| Nom_2_Nitrogen * Nom_2_Mn_S_Ratio | 387.696 | 1 | 387.696 | 2.717 | .099 |
| Nom_2_TundishTemp * Nom_2_Nitrogen * Nom_2_Mn_S_Ratio | 831.865 | 1 | 831.865 | 5.829 | .016 |
| Nom_2_CastSpeed * Nom_2_Mn_S_Ratio | 27.716 | 1 | 27.716 | .194 | .659 |
| Nom_2_TundishTemp * Nom_2_CastSpeed * Nom_2_Mn_S_Ratio | 423.801 | 1 | 423.801 | 2.970 | .085 |
| Nom_2_Nitrogen * Nom_2_CastSpeed * Nom_2_Mn_S_Ratio | 417.891 | 1 | 417.891 | 2.928 | .087 |
| Nom_2_TundishTemp * Nom_2_Nitrogen * Nom_2_CastSpeed * Nom_2_Mn_S_Ratio | 6.805 | 1 | 6.805 | .048 | .827 |
| Nom_2_Mn_Si_ratio * Nom_2_Mn_S_Ratio | 4838.907 | 1 | 4838.907 | 33 909 | .000 |
| Nom_2_TundishTemp * Nom_2_Mn_Si_ratio * Nom_2_Mn_S_Ratio | 1269.925 | 1 | 1269.925 | 8.899 | .003 |
| Nom_2_Nitrogen * Nom_2_Mn_Si_ratio * Nom_2_Mn_S_Ratio | 484.197 | 1 | 484.197 | 3.393 | .066 |
| Nom_2_TundishTemp * Nom_2_Nitrogen * Nom_2_Mn_Si_ratio Nom_2_Mn_S_Ratio | 486.009 | 1 | 486.009 | 3.406 | .065 |
| Nom_2_CastSpeed Nom_2_Mn_Si_ratio * Nom_2_Mn_S_Ratio | 536.336 | 1 | 536.336 | 3.758 | .053 |
| Nom_2_TundishTemp * Nom_2_CastSpeed * Nom_2_Mn_Si_ratio Nom_2_Mn_S_Ratio | 14.180 | 1 | 14.180 | .099 | .753 |
| Nom_2_Nitrogen * Nom_2_CastSpeed * Nom_2_Mn_Si_ratio Nom_2_Mn_S_Ratio | 1602.869 | 1 | 1602.869 | 11.232 | .001 |
| Nom_2_TundishTemp * Nom_2_Nitrogen * Nom_2_CastSpeed * | 20.909 | 1 | 20.909 | .147 | .702 |

TABLE II-continued

TESTS OF BETWEEN-SUBJECTS EFFECTS
Dependent Variable: Sum_C

| Source | Type III Sum of Squares | df | Mean Square | F | Sig. |
|---|---|---|---|---|---|
| Nom_2_Mn_Si_ratio_Nom_2_Mn_S_Ratio | | | | | |
| Nom_2_Carbon | 572.876 | 1 | 572.876 | 4.014 | .045 |
| Nom_2_Mn_S_Ratio | | | | | |
| Nom_2_TundishTemp * | 686.005 | 1 | 686.005 | 4.807 | .028 |
| Nom_2_Carbon * | | | | | |
| Nom_2_Mn_S_Ratio | | | | | |
| Nom_2_Nitrogen * | 242.113 | 1 | 242.113 | 1.697 | .193 |
| Nom_2_Carbon * | | | | | |
| Nom_2_Mn_S_Ratio | | | | | |
| Nom_2_TundishTemp * | 194178 | 1 | 194.178 | 1.361 | .243 |
| Nom_2_Nitrogen | | | | | |
| Nom_2_Carbon * | | | | | |
| Nom_2_Mn_S_Ratio | | | | | |
| Nom_2_CastSpeed * | 198.290 | 1 | 198.290 | 1.390 | .239 |
| Nom_2_Carbon * | | | | | |
| Nom_2_Mn_S_Ratio | | | | | |
| Nom_2_TundishTemp * | 2.489 | 1 | 2.489 | .017 | .895 |
| Nom_2_CastSpeed * | | | | | |
| Nom_2_Carbon * | | | | | |
| Nom_2_Mn_S_Ratio | | | | | |
| Nom_2_Nitrogen * | 252.648 | 1 | 252.648 | 1.770 | .183 |
| Nom_2_CastSpeed * | | | | | |
| Nom_2_Carbon * | | | | | |
| Nom_2_Mn_S_Ratio | | | | | |
| Nom_2_TundishTemp * | 640.454 | 1 | 640.454 | 4.488 | .034 |
| Nom_2_Nitrogen * | | | | | |
| Nom_2_CastSpeed * | | | | | |
| Nom_2_Carbon * | | | | | |
| Nom_2_Mn_S_Ratio | | | | | |
| Nom_2_Mn_Si_ratio | 174.833 | 1 | 174.833 | 1.225 | .268 |
| Nom_2_Carbon * | | | | | |
| Nom_2_Mn_S_Ratio | | | | | |
| Nom_2_TundishTemp * | 1.303 | 1 | 1.303 | .009 | .924 |
| Nom_2_Mn_Si_ratio * | | | | | |
| Nom_2_Carbon * | | | | | |
| Nom_2_Mn_S_Ratio | | | | | |
| Nom_2_Nitrogen * | 167.640 | 1 | 167.640 | 1.175 | .279 |
| Nom_2_Mn_Si_ratio * | | | | | |
| Nom_2_Carbon * | | | | | |
| Nom_2_Mn_S_Ratio | | | | | |
| Nom_2_TundishTemp * | 138.327 | 1 | 138.327 | .969 | .325 |
| Nom_2_Nitrogen * | | | | | |
| Nom_2_Mn_Si_ratio * | | | | | |
| Nom_2_Carbon * | | | | | |
| Nom_2_Mn_S_Ratio | | | | | |
| Nom_2_CastSpeed * | 296.352 | 1 | 296.352 | 2.077 | .150 |
| Nom_2_Mn_Si_ratio * | | | | | |
| Nom_2_Carbon * | | | | | |
| Nom_2_Mn_S_Ratio | | | | | |
| Nom_2_TundishTemp * | 422.782 | 1 | 422.782 | 2.963 | .085 |
| Nom_2_CastSpeed * | | | | | |
| Nom_2_Mn_Si_ratio * i | | | | | |
| Nom_2_Carbon * | | | | | |
| Nom_2_Mn_S_Ratio | | | | | |
| Nom_2_Nitrogen * | 33.001 | 1 | 33.001 | .231 | .631 |
| Nom_2_CastSpeed * | | | | | |
| Nom_2_Mn_Si_ratio * | | | | | |
| Nom_2_Carbon * | | | | | |
| Nom_2_Mn_S_Ratio | | | | | |
| Error | 501171.975 | 3512 | 142.703 | | |
| Total | 626271.000 | 3575 | | | |
| Corrected Total | 696840.105 | 3574 | | | |

As shown in Table II, statistical correlations were found the particular levels of each of the parameters reposted above, namely manganese/sulfur ratio, manganese/silicon ratio, casting speed, carbon content, nitrogen content, and tundish temperature.

The continuously thin cast strip may be of low carbon steel, which may include 2.5% or less silicon, 0.5% or less chromium, less than 0.005% by weight titanium, 2.0% or less manganese, 0.5% or less nickel, 0.25% or less molybdenum, and 1.0% or less aluminum, together with sulfur between 0.003 and 0.008% and phosphorus and other impurities at levels that normally occur in making carbon steel by electric arc furnace. Low carbon steel, for example, may vary to have manganese content in the range 0.01% to 2.0% by weight, and silicon content in the range 0.01% to 2.5% by weight. In any event, the steel may have aluminum content of the order of 0.1% or less by weight, and may be 0.06% or less by weight. In addition to or in the alternative, the steel may have a vanadium content of the order of 0.02% or less and a niobium content on the order of 0.01% or less.

While this invention has been described and illustrated with reference to various embodiments, it shall be understood that such description is by way of illustration and not by way of limitation. Accordingly, the scope and content of the present invention are to be defined only by the terms of the appended claims.

We claim:

1. A method of casting thin steel strip comprising:

a. assembling a pair of internally cooled casting rolls having a nip therebetween and with confining closures adjacent the ends of the nip;

b. introducing molten carbon steel having a carbon content of between about 0.010% and about 0.065% by weight, less than 5.0% by weight chromium, at least 70 ppm of total oxygen and between 20 and 70 ppm of free oxygen, and an average manganese to sulfur ratio at least 250 between the pair of casting rolls to form a casting pool supported on the casting surfaces of the casting rolls;

c. counter rotating the casting rolls to form solidified metal shells on the casting surfaces of the casting rolls; and d. forming from said solidified shells thin steel strip downwardly through the nip between the casting rolls.

2. The method of casting thin steel strip as claimed in claim 1 where the molten steel has a carbon content between about 0.025% and about 0.065% by weight.

3. The method of casting thin steel strip as claimed in claim 1 where the molten steel has a carbon content below about 0.035% by weight.

4. The method of casting thin steel strip as claimed in claim 1 where the molten steel has a titanium content less than 0.005% by weight.

5. The method of casting thin steel strip as claimed in claim 1 where the molten carbon steel in the casting pool has a total oxygen content of at least 100 ppm and a free oxygen content between 30 and 50 ppm.

6. The method of casting thin steel strip as claimed in claim 1 where the molten carbon steel in the casting pool has a nitrogen content less than about 52 ppm.

7. The method of casting thin steel strip as claimed in claim 1 where the steel strip is cast at a casting speed less than 76.68 meters per minute.

8. The method of casting thin steel strip as claimed in claim 1 where a tundish temperature of the molten steel is maintained below 1612° C. (2933.7° F.).

9. The method of casting thin steel strip as claimed in claim 1 where the molten steel has a chromium content below 1.5% by weight.

10. The method of casting thin steel strip as claimed in claim 1 where the molten steel has a chromium content below 0.5% by weight.

11. The method of casting thin steel strip as claimed in claim 1 where the steel strip contains, by weight, less than 0.1% aluminum, less than 0.005% titanium, less than 0.01% niobium, and less than 0.02% vanadium.

12. The method of casting thin steel strip as claimed in claim 1 where the sum of the partial pressures of hydrogen and nitrogen in the casting pool is less than 1.15 atmospheres.

13. A method of casting thin steel strip comprising:

a. assembling a pair of internally cooled casting rolls having a nip therebetween and with confining closures adjacent the ends of the nip;

b. introducing molten carbon steel having a carbon content of between about 0.010% and about 0.065% by weight, less than 5.0% by weight chromium, at least 70 ppm of total oxygen and between 20 and 70 ppm of free oxygen, an average manganese to sulfur ratio at least 250, the average manganese to silicon ratio in the strip produced is greater than 3.5 between the pair of casting rolls to form a casting pool supported on the casting surfaces of the casting rolls;

c. counter rotating the casting rolls to form solidified metal shells on the casting surfaces of the casting rolls; and d. forming from said solidified shells thin steel strip downwardly through the nip between the casting rolls.

14. The method of casting thin steel strip as claimed in claim 13 where the molten steel has a carbon content between about 0.025% and about 0.065% by weight.

15. The method of casting thin steel strip as claimed in claim 13 where the molten steel has a carbon content below about 0.035% by weight.

16. The method of casting thin steel strip as claimed in claim 13 where the molten steel has a titanium content less than 0.005% by weight.

17. The method of casting thin steel strip as claimed in claim 13 where the molten carbon steel in the casting pool has a total oxygen content of at least 100 ppm and a free oxygen content between 30 and 50 ppm.

18. The method of casting thin steel strip as claimed in claim 13 where the molten carbon steel in the casting pool has a nitrogen content less than about 52 ppm.

19. The method of casting thin steel strip as claimed in claim 13 where the steel strip is cast at a casting speed less than 76.68 meters per minute.

20. The method of casting thin steel strip as claimed in claim 13 where a tundish temperature of the molten steel is maintained below 1612° C. (2933.7° F.).

21. The method of casting thin steel strip as claimed in claim 13 where the molten steel has a chromium content below 1.5% by weight.

22. The method of casting thin steel strip as claimed in claim 13 where the molten steel has a chromium content below 0.5% by weight.

23. The method of casting thin steel strip as claimed in claim 13 where the steel strip contains, by weight, less than 0.1% aluminum, less than 0.005% titanium, less than 0.01% niobium, and less than 0.02% vanadium.

24. The method of casting thin steel strip as claimed in claim 13 where the sum of the partial pressures of hydrogen and nitrogen in the casting pool is less than 1.15 atmospheres.

* * * * *